US008224197B2

(12) United States Patent
Mohri et al.

(10) Patent No.: US 8,224,197 B2
(45) Date of Patent: Jul. 17, 2012

(54) IMAGE FORMING APPARATUS, PRINTING OPERATION CONTROL METHOD AND COMPUTER-READABLE INFORMATION RECORDING MEDIUM

(75) Inventors: Kazuo Mohri, Hyogo (JP); Yuuya Ozaki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 234 days.

(21) Appl. No.: 12/723,735

(22) Filed: Mar. 15, 2010

(65) Prior Publication Data

US 2010/0239277 A1 Sep. 23, 2010

(30) Foreign Application Priority Data

Mar. 17, 2009 (JP) ..... 2009-064573
Mar. 9, 2010 (JP) ..... 2010-052379

(51) Int. Cl.
*G03G 15/00* (2006.01)
*G03G 15/20* (2006.01)
*G03G 21/20* (2006.01)

(52) U.S. Cl. ..... 399/43; 399/70; 399/92

(58) Field of Classification Search ..... 399/43, 399/38, 75, 92, 96, 70
See application file for complete search history.

(56) References Cited

U.S. PATENT DOCUMENTS

2009/0116859 A1 5/2009 Mohri

FOREIGN PATENT DOCUMENTS

| | | | |
|---|---|---|---|
| JP | 58-116544 | | 7/1983 |
| JP | 01-172853 | | 7/1989 |
| JP | 05-241405 | | 9/1993 |
| JP | 07-128919 A | * | 5/1995 |
| JP | 2003-043757 | | 2/2003 |

* cited by examiner

*Primary Examiner* — Sophia S Chen
(74) *Attorney, Agent, or Firm* — IPUSA, PLLC

(57) ABSTRACT

An image forming apparatus includes a photosensitive member driving part that drives a photosensitive member, a counting part that carries out an adding operation when the photosensitive member driving part drives the photosensitive member, and carries out a subtracting operation when the photosensitive member driving part stops the photosensitive member; and a control part that interrupts, when a count value of the counting part becomes equal to or more than a first predetermined value, a printing operation of driving the photosensitive member, forming an electrostatic latent image on the photosensitive member, and fixing a toner adhering to the photosensitive member onto a recording sheet, and causes the counting part to start the subtracting operation.

19 Claims, 26 Drawing Sheets

FIG.15A

15

| | | KISYU | |
|---|---|---|---|
| | | 0 | 1 |
| ON BOTH-SIDES PRINTING | DUP[KISYU] | 2 | 4 |
| ON SINGLE-SIDE PRINTING | SIMP[KISYU] | 1 | 2 |
| OTHER THAN PRINTING | NOT_PRN[KISYU] | 1 | 2 |

FIG.15B

16

| | | KISYU | |
|---|---|---|---|
| | | 0 | 1 |
| EQUAL TO OR MORE THAN C2 | C2_OVER[KISYU] | 6 | 3 |
| LESS THAN C2 | C2_UNDER[KISYU] | 1 | 1 |

IMAGE FORMING APPARATUS, PRINTING OPERATION CONTROL METHOD AND COMPUTER-READABLE INFORMATION RECORDING MEDIUM

BACKGROUND OF THE INVENTION

1. Field of the Invention

The present invention relates to an image forming apparatus, a printing operation control method and a computer-readable information recording medium that stores a computer program for carrying out a printing operation of forming an electrostatic latent image on a photosensitive member and fixing toner that adheres to the electrostatic latent image onto a recording medium.

2. Description of the Related Art

In a technical field of an image forming apparatus having a photosensitive member, it is known that, as a photosensitive member surface temperature increases, a state of the photosensitive member surface and/or image forming condition varies, which may result in degradation of an image formed in the image forming apparatus. An increase in the photosensitive member surface temperature may occur because of friction between the photosensitive member and a peripheral developing roller or transfer roller, friction heat caused by rotation of the roller, heat transmitted from a fixing device and so forth.

In the image forming apparatus, as the photosensitive member surface temperature becomes a predetermined temperature or more, the photosensitive member surface may be damaged. In the image forming apparatus, if the photosensitive member surface is damaged, the damaged part cannot be used for development. Therefore, an image output from the image forming apparatus has a blank corresponding to the damaged part, and thus, the image is defective.

In order to solve such a problem of an image defect caused by the photosensitive member surface temperature increase, the photosensitive member surface temperature is measured, and a printing operation in the image forming apparatus is continued or interrupted according to a thus-obtained temperature, for example.

FIG. 1 shows a state in which the photosensitive member surface temperature increases during a both-sides printing operation. A broken line in FIG. 1 shows a threshold for a temperature zone such that there is a high likelihood of occurrence of an image defect if the photosensitive member surface temperature becomes the threshold or more. In an example of FIG. 1, at a room temperature of 28° C. that is within an image compensation range, the photosensitive member surface temperature reaches the threshold (44° C.) when a printing operation is continued for approximately 55 minutes. In this case, such a control can be carried out that a printing operation is made to go on at a temperature of less than 44° C., and is interrupted at a temperature of 44° C. or more.

For example, according to Japanese Laid-Open Patent Applications Nos. 05-241405, 01-172853 and 58-116544, a photosensitive member surface temperature of a fixing temperature is measured, and printing is allowed according to a result of the measurement. By this method, it is possible to reflect the photosensitive member surface temperature in a printing operation, and it is possible to easily solve a problem of an image defect.

However, in order to realize the method, it is necessary to provide a sensor (temperature sensor) for measuring a temperature, which may result in a cost increase. Further, it is necessary to secure a space for disposing the temperature sensor. In conjunction with the space for disposing the temperature sensor, Japanese Laid-Open Patent Application No. 2003-043757 discusses the use of a measured temperature of another member that is in contact with the photosensitive member instead of directly measuring the photosensitive member surface temperature. Another method is to use a non-contact type temperature sensor (thermopile).

SUMMARY OF THE INVENTION

According to the present invention, an image forming apparatus includes a photosensitive member driving part configured to drive a photosensitive member; the photosensitive member configured to be driven by the photosensitive member driving part and have an electrostatic latent image formed thereon; a fixing part configured to fix a toner that adheres to the electrostatic latent image onto a recording sheet; a counting part configured to carry out an adding operation when the photosensitive member driving part drives the photosensitive member, and carry out a subtracting operation when the photosensitive member driving part stops the photosensitive member; and a control part configured to interrupt, when a count value of the counting part becomes equal to or more than a first predetermined value, a printing operation of driving the photosensitive member, forming the electrostatic latent image on the photosensitive member, and fixing the toner adhering to the photosensitive member onto the recording sheet, and cause the counting part to start the subtracting operation.

Other objects, features and advantages of the present invention will become more apparent from the following detailed description when read in conjunction with the accompanying drawings.

BRIEF DESCRIPTION OF THE DRAWINGS

FIGS. 15A and 15B show one example of an adding amount table 15 and a subtracting amount table 16;

DETAILED DESCRIPTION OF THE PREFERRED EMBODIMENTS

In any one of methods discussed in above-mentioned Japanese Laid-Open Patent Applications Nos. 05-241405, 01-172853, 58-116544 and 2003-043757, a temperature sensor is necessary, and thus, a cost increase results.

Figure 1:
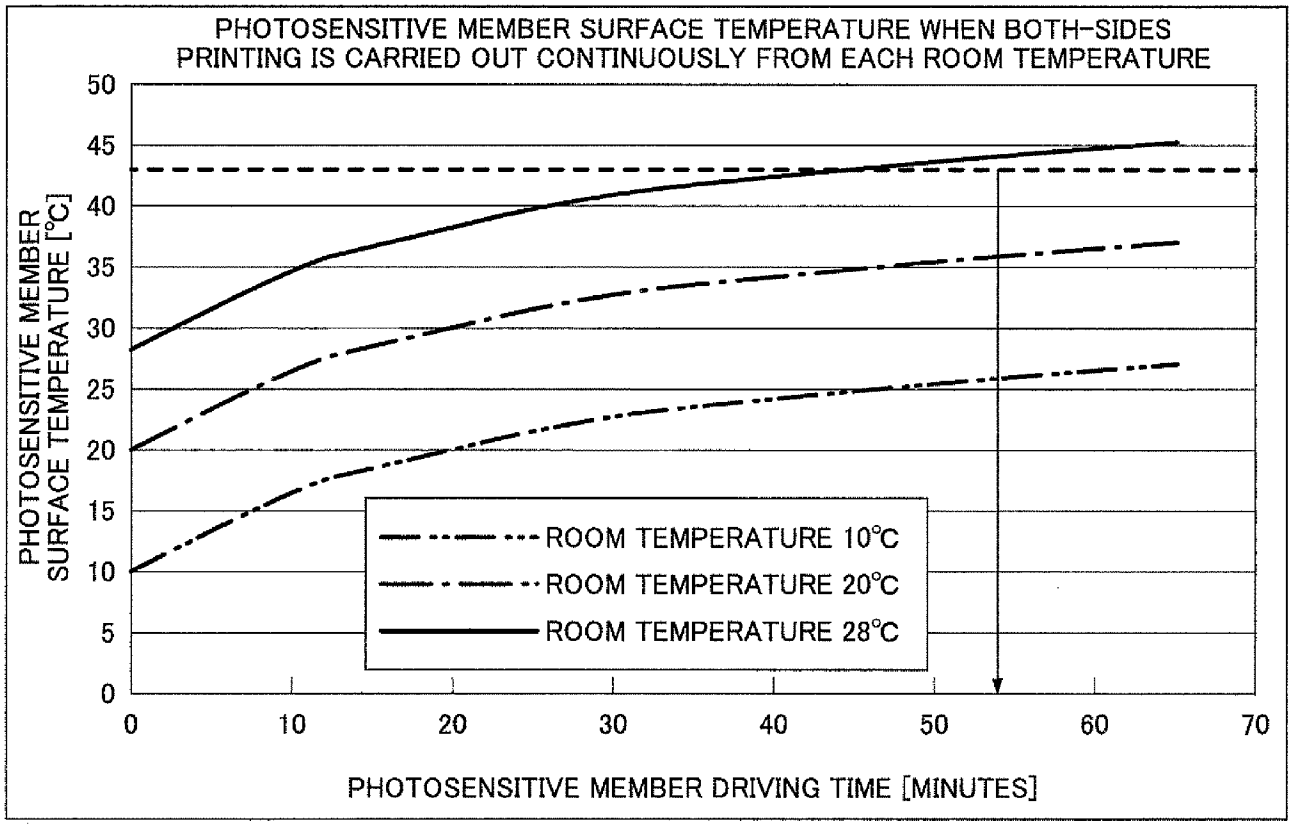
FIG. 1 shows a state of a photosensitive member surface temperature increase during a printing operation.
Figure 2:
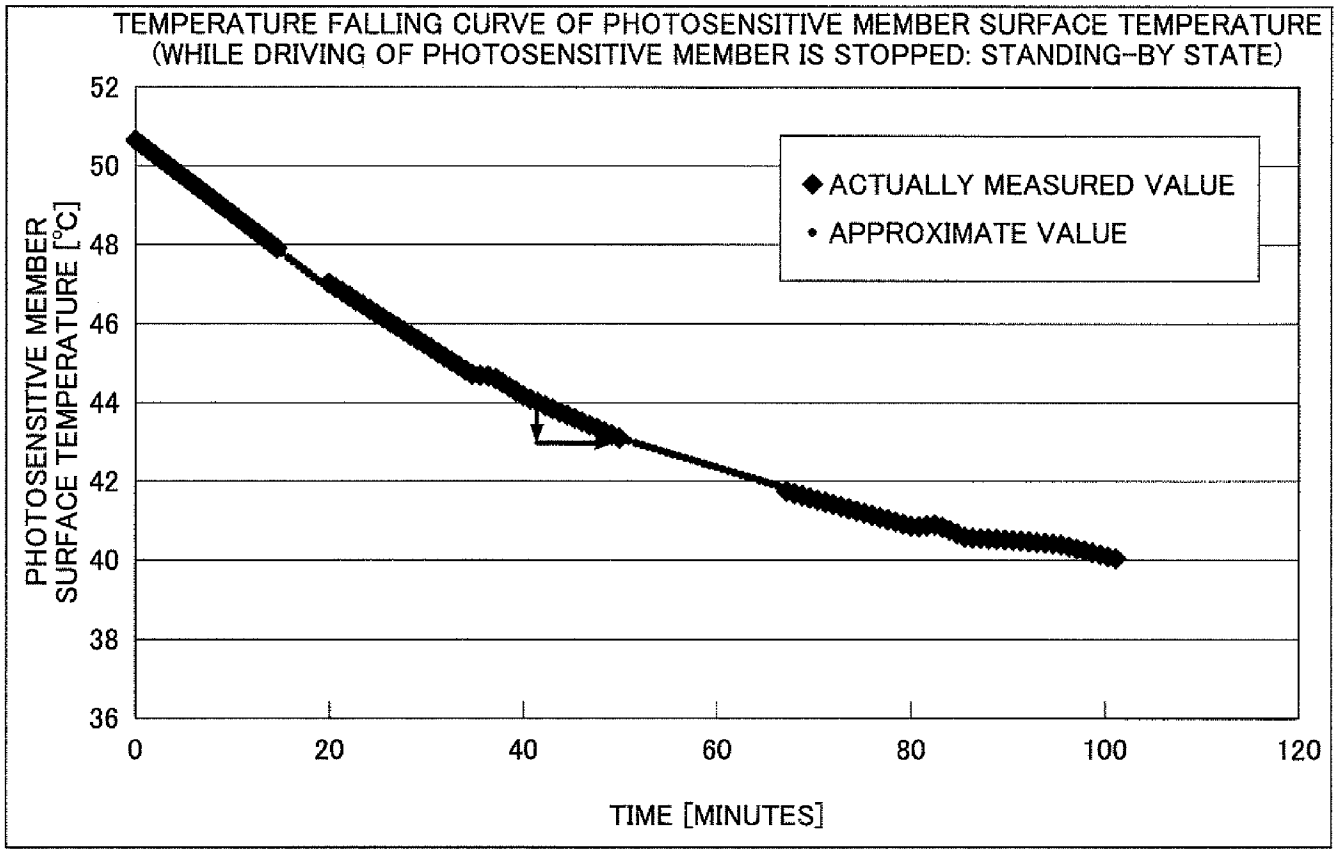
FIG. 2 shows a photosensitive member surface temperature decrease curve during a standing-by operation.

Further, in a case of continuing and interrupting a printing operation according to a temperature detected by the temperature sensor, a downtime occurs from a time at which the temperature is a print preventing temperature through a time at which the temperature has decreased to a print allowing temperature. FIG. 2 shows that, in a case where the print preventing temperature is set as 44° C., and the print allowing temperature is set as the temperature lower than the print preventing temperature by 1° C., it is necessary to interrupt a printing operation for a time interval on the order of 10 minutes. A downtime of such a long time interval may cause remarkable degradation in productivity. FIG. 2 shows a photosensitive member surface temperature falling curve during a standing-by operation.

Embodiments of the present invention described below have been devised in consideration of the situation for the purpose of solving the problem. According to the embodiments of the present invention, an image forming apparatus, a printing operation control method and a computer-readable information recording medium that stores a computer program are provided, in which no special temperature sensor is used for detecting a photosensitive member surface temperature, and degradation in productivity caused by a long-time interruption time (downtime) can be reduced.

More specifically, according to the embodiments of the present invention, no special temperature sensor is used for detecting a photosensitive member surface temperature, a count value of a counter is used to determine a state of the photosensitive member, and it is determined whether printing can be made to continue. Thereby, it is possible to reduce an interruption time of a printing operation for each occurrence of an interruption, and an occurrence of an image defect is avoided.

First Embodiment

Figure 3:
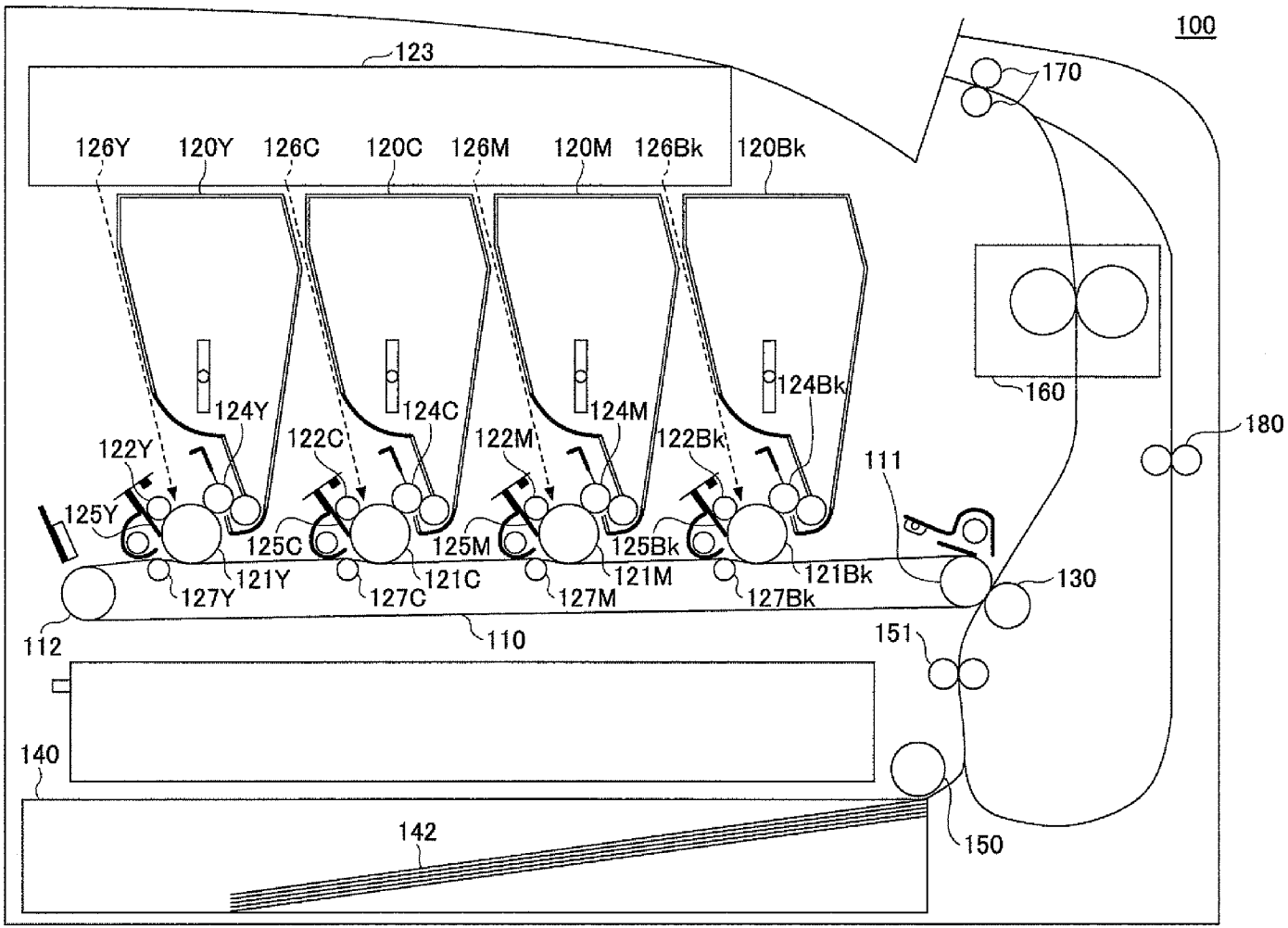
FIG. 3 illustrates a structure of an image forming apparatus 100 in the first embodiment of the present invention.

A first embodiment of the present invention will now be described with reference to figures. FIG. 3 illustrates an image forming apparatus 100 in the first embodiment of the present invention.

As shown in FIG. 3, the image forming apparatus 100 is of a so-called tandem-type, and includes AIO (All-In-One) cartridges (120Bk, 120M, 120C and 120Y) of respective colors arranged along a transfer belt 110.

The transfer belt 110 rotates counterclockwise in FIG. 3, and the plural AIO cartridges (referred to as image forming parts, hereinafter) 120Bk, 120M, 120C and 120Y are arranged in the stated order from an upstream side of a rotating direction. The plural image forming part 120Bk, 120M, 120C and 120Y have a common structure and have respective colors of toner images different from one another. The image forming parts 120Bk, 120M, 120C and 120Y form a black image, a magenta image, cyan image, and a yellow image, respectively.

Below, the image forming part 120Bk will be described in detail. The other image forming parts 120M, 120C and 120Y are the same as the image forming part 120Bk. Therefore, for the image forming parts 120M, 120C and 120Y, reference numerals are given as follows, and description thereof will be omitted.

The transfer belt 110 is an endless belt wound on a secondary transfer driving roller 111 and a transfer belt tension roller 112. The secondary transfer driving roller 111 is driven and rotated by a driving motor (not shown), and the driving motor, the secondary transfer driving roller 111 and the transfer roller 112 act as a driving part that drives the transfer belt 110.

The image forming part 120Bk includes a photosensitive member 121Bk, and a charger 122Bk (likewise chargers 122M, 122C, 122Y for the other image forming parts 120M, 120C and 120Y), an exposure unit 123, a developer 124Bk, a cleaner blade 125Bk (likewise cleaner blades 125M, 125C, 125Y for the other image forming parts 120M, 120C and 120Y) and so forth, which are arranged in the periphery of the photosensitive member 121Bk. The exposure unit 123 is configured to irradiate laser light 126Bk, 126M, 126C and 126Y that is exposure light corresponding to the image colors of the respective image forming parts 120Bk, 120M, 120C and 120Y.

In the first embodiment, in an image forming operation, an outer circumferential surface of the photosensitive member 121Bk is charged uniformly by the charger 122Bk in the dark, then, is exposed by laser light 126Bk corresponding to a black image from the exposure unit 123, and thus, has an electrostatic latent image formed thereon. The developer 124Bk changes the electrostatic latent image thus formed on the outer circumferential surface of the photosensitive member 121Bk into a visualized toner image by applying a black toner, and thus, forms a black toner image on the outer circumferential surface of the photosensitive member 121Bk.

The toner image thus formed on the outer circumferential surface of the photosensitive member 121Bk is transferred onto the transfer belt 110 at a position (a primary transfer position) at which the photosensitive member 121Bk comes into contact with the transfer belt 110 by a function of a primary transfer roller 127Bk. By this transfer, the black toner image is transferred onto the transfer belt 110. The photosensitive member 121Bk from which the toner image has been thus transferred has a remaining unnecessary toner wiped off by the cleaner blade 125Bk, and stands by for a subsequent image forming operation.

The black toner image thus transferred onto the transfer belt 110 is conveyed to the next image forming part 120M by the transfer belt 110. The image forming part 120M forms a magenta toner image on an outer circumferential surface of the photosensitive member 121M by the same process as the above-described image forming process of the image forming part 120Bk. The thus-formed magenta toner image is then transferred to the transfer belt 110 over the black toner image already formed on the transfer belt 110.

The black and magenta toner images thus transferred onto the transfer belt 110 in a one-over-the-other manner are then conveyed to the next image forming parts 120C and 120Y in sequence. Then, in the same operation, a cyan toner image formed on an outer circumferential surface of the photosensitive member 121C and a yellow toner image formed on an outer circumferential surface of the photosensitive member 121Y are transferred to the transfer belt 110 over the black and magenta toner images already formed on the transfer belt 110 in a one-over-the-other manner. Thus, on the transfer belt 110, a full color toner image is formed as a result of the black, magenta, cyan and yellow toner images being transferred in a one-over-the-other manner. The full color toner image thus formed on the transfer belt 110 is then conveyed to a position of the secondary transfer roller 130.

It is noted that, in a case where printing is carried out only with the black toner, primary transfer rollers 127M, 127C and 127Y are moved to positions away from the photosensitive members 121M, 121C and 121Y, respectively. Thus, in this case, the above-mentioned image forming process is carried out only with the image forming part 120Bk for forming a black toner image.

Paper sheets 142 contained in a paper feeding tray 140 are fed in sequence from the top one as a result of a paper feeding roller 150 being rotated counterclockwise in a paper conveying operation of an image forming operation. The thus-fed paper sheet stands by at a position of a registration roller 151. Driving of the registration roller 151 is started at such timing that a position of a toner image that has been conveyed by the transfer belt 110 agrees with a position of the paper sheet 142 on the secondary transfer roller 130. At this time, the registration roller 151 feeds the paper sheet 142 as a result of being driven and rotated counterclockwise.

The paper sheet 142 thus fed by the registration roller 151 has the toner image transferred thereto from the transfer belt 110 by the secondary transfer roller 130. After that, the toner image thus transferred to the paper sheet 142 is fixed onto the paper sheet 142 by the fixing unit 160 with heat and pressure. Then, the paper sheet 142 is ejected to the outside of the image forming apparatus 100 by ejecting rollers 170 that are driven and rotated in such directions that the paper sheet 142 is ejected (referred to as ejecting directions, hereinafter).

In a case where a both-sides printing is carried out, before the paper sheet 142 passes through the ejecting rollers 170, the ejecting rollers 170 are driven and rotated in directions reverse to the ejecting directions, and thus the paper sheet 142 is conveyed to a both-sides conveyance path. The paper sheet 142 thus conveyed into the both-sides conveyance path then passes through a both-sides roller 180, and then, is again conveyed to the registration roller 151. The paper sheet 142 thus conveyed to the registration roller 151 is again fed from the registration roller 151, and has a toner image transferred to a reverse side of the paper sheet 142 by the secondary transfer roller 130. The transferred toner image is fixed by the fixing unit 160 with heat and pressure, and is ejected to the outside of the image forming apparatus 100 by the ejecting rollers 170 that are driven and rotated in the ejecting directions.

Figure 4:
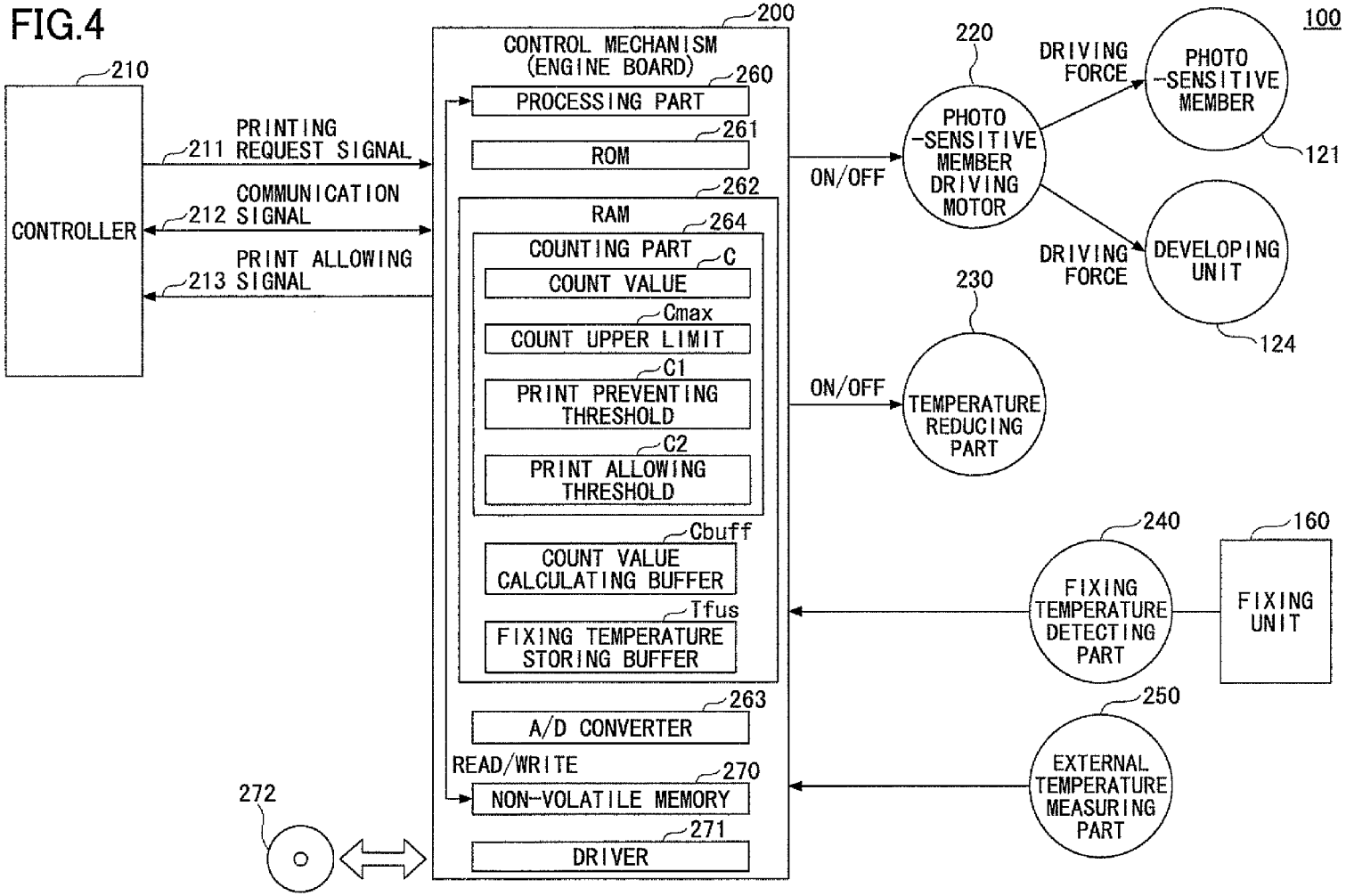
FIG. 4 illustrates functions of an image forming apparatus 100 in a first embodiment of the present invention.

Next, with reference to FIG. 4, a functional configuration of the image forming apparatus 100 in the first embodiment of the present invention will be described. FIG. 4 illustrates the functional configuration of the image forming apparatus 100 in the first embodiment.

The image forming apparatus 100 includes a control mechanism (engine board) 200, a controller 210, a photosensitive member driving motor 220, a temperature reducing part 230, a fixing temperature detecting part 240 and an external temperature measuring part 250.

The control mechanism 200 controls an operation of the image forming apparatus 100, and includes a processing part 260, a ROM (Read Only Memory) 261, a RAM (Random Access Memory) 262, an A/D (Analog to Digital) converter 263, a non-volatile memory 270, and a drive 271.

The processing part 262 is a CPU (Central Processing Unit) for causing the image forming apparatus 100 to function properly. The ROM 261 is a fixed storage device that stores a computer program, and so forth. The RAM 262 is a main storage of the processing part 260, and includes a counting part 264.

The processing part 262 in the first embodiment carries out a process described below with reference to flowcharts by executing a printing operation control program (computer program) stored in the ROM 261. It is noted that the printing operation control program may be stored in a recording medium 272. In this case, the printing operation control program may be driven by the driver 271 from the recording medium 272, stored in the RAM 262, and executed by the processing part 260.

It is noted that the recording medium 272 may be a computer-readable information recording medium such as a CD-ROM (Compact Disk Read Only Memory) or such. In a case where the image forming apparatus 100 includes a communication unit that carries out network communication with the outside, the printing operation control program may be downloaded via a communication network by the communication unit, and installed in the RAM 264. Further, in a case where the image forming apparatus 100 has an interface such as a USE (Universal Serial Bus) that connects with an external storage device, the printing operation control program may be read from the external storage device via a USE connection.

The A/D converter 263 is included in the processing part 260 in a built-in manner, and converts data indicating a temperature measured by the fixing temperature measuring part 240 and the external temperature measuring part 250 into digital data.

The counting part 264 is a part of the RAM 262, and stores a count value C to be incremented or decremented by the processing part 260 according to a driving state of the photosensitive member driving part 220. Specifically, the processing part 260 increments the count value C when the photosensitive member driving motor rotates, and decrements the count value C when the photosensitive member driving motor 220 stops.

Further, in the first embodiment, the processing part 260 carries out incrementing (adding) or decrementing (subtracting) the count value C according to a state of the image forming apparatus 100. For example, the processing part 260 increments the count value C by 2 in a case where a both-sides printing operation is carried out, and by 1 in a case where a one-side printing operation or a warming up operation is carried out. The warming up operation is a preparing operation for making it possible to carry out a printing operation in the image forming apparatus 100 after a power supply is started in the image forming apparatus 100 or after the image forming apparatus 100 returns from an energy saving mode such as a sleep mode.

Further, the processing part 260 carries out decrementing the count value C, for example, according to an internal temperature (a temperature in the inside) of the image forming apparatus 100, in a case where the photosensitive member driving motor 220 stops.

The RAM 262 includes a count value calculating buffer Cbuff, and a fixing temperature storing buffer Tfus as will be described later. The count value calculating buffer Cbuff stores a value that acts as an initial value used when the counting value is calculated. The fixing temperature storing buffer Tfus stores a temperature of the fixing unit 160 detected by the fixing temperature detecting part 240 when a power supply in the image forming apparatus 100 is started and when the image forming apparatus 100 returns from the energy saving mode such as the sleep mode.

The counting part 264 previously stores thresholds used by the processing part 260 to determine whether to interrupt a printing operation. The processing part 260 determines whether to interrupt a printing operation by comparing the thresholds previously stored in the counting part 264 and the count value C also stored in the counting part 264, as will be described later.

It is noted that, "to interrupt a printing operation" in the first embodiment means to interrupt a printing operation in timing after the completion of printing of a current page before starting of printing of a subsequent page. Therefore, when a printing operation is interrupted, a paper sheet 142 has passed through the inside of the image forming apparatus 100, and has been ejected to the outside of the image forming apparatus 100. A state in which any paper sheet(s) 142 is(are) on passing through the inside of the image forming apparatus 100 will be referred as a paper passing state, hereinafter.

The non-volatile memory 270 acts as a non-volatile storing part.

Next, the above-mentioned count value C stored in the counting part 264 in the first embodiment will be described.

The count value C stored in the counting part 264 in the first embodiment corresponds to the photosensitive member surface temperature (a surface temperature of the photosensitive member 121 (including the photosensitive members 121Bk, 121M, 121C and 121Y)). The values previously stored in the counting part 264 include a count upper limit Cmax, a print preventing threshold C1, and a print allowing threshold C2. It is noted that the RAM 262 includes a volatile area and a non-volatile area such as a NVRAM, the count value C is stored in the volatile area and the thresholds Cmax, C1 and C2 are stored in the non-volatile area.

The count upper limit Cmax indicates the count value C of the counting part 264 in a state in which the photosensitive member surface temperature reaches an upper limit, and thus, the photosensitive member surface temperature is saturated. Therefore, in a case where the count value C of the counting part 264 is the count upper limit Cmax, it can be seen that the photosensitive member surface temperature reaches the upper limit.

The print preventing threshold C1 is a value for controlling an increase of the photosensitive member surface temperature. In a case where the count value C of the counting part 264 in the first embodiment is the print preventing threshold C1 or more, it can be seen that the photosensitive member surface temperature increases at a permissible rate or more.

The print allowing threshold C2 is a threshold used to determine whether to re-start a printing operation.

Thus, the processing part 260 in the first embodiment determines that the photosensitive member surface temperature is saturated in a case where the count value C of the counting part 264 is the count upper limit Cmax. Further, the processing part 260 determines that a current state is such a state that an image defect may occur, in a case where the count value C of the counting part 264 is the print preventing threshold C1 or more. Further, the processing part 260 determines that a current state is such a state that an image defect does not occur, in a case where the count value C of the counting part 264 is less than the print allowing threshold C2.

Figure 5:
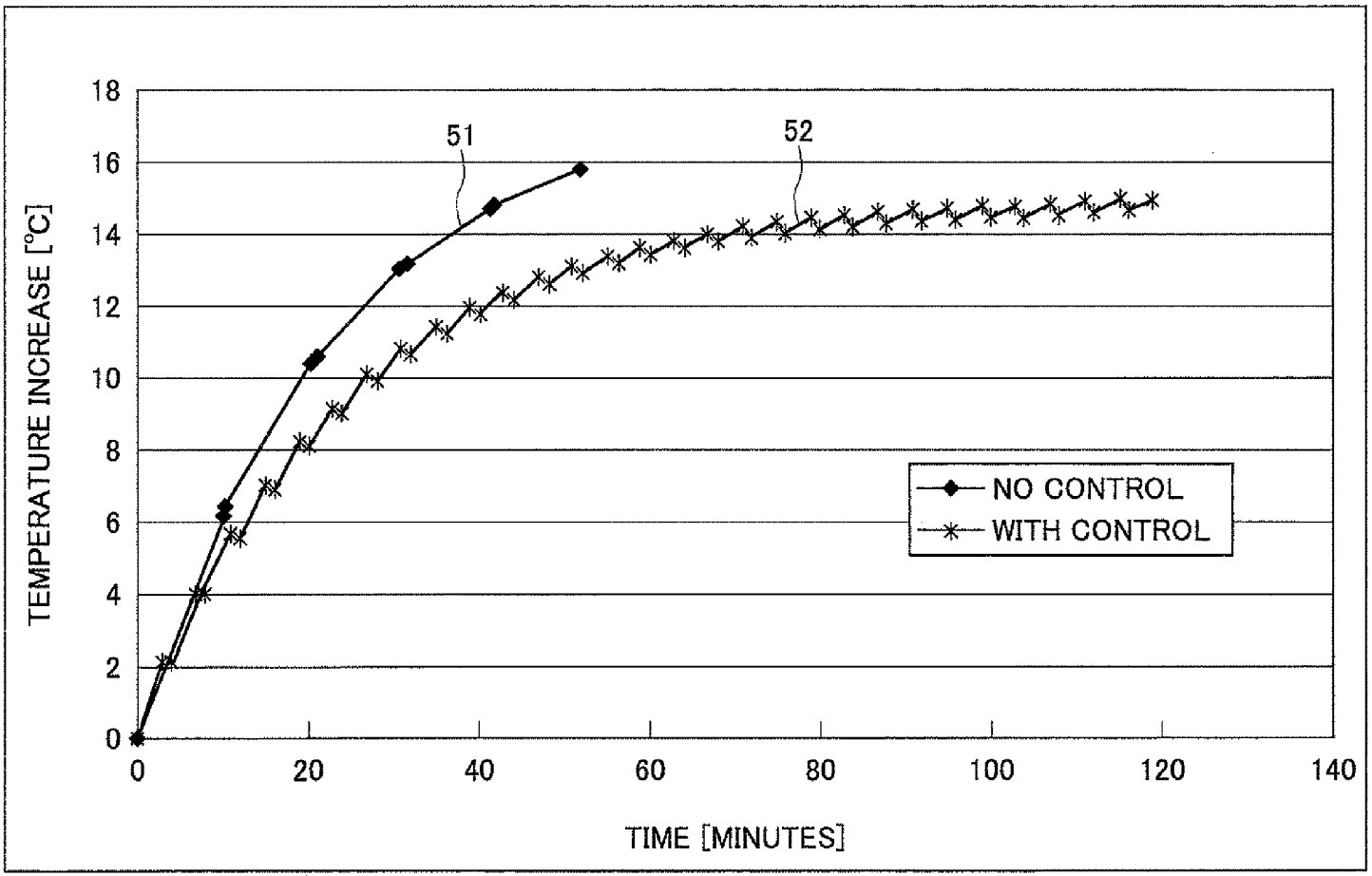
FIG. 5 shows a photosensitive member surface temperature increase during a printing operation in the first embodiment of the present invention.

The count upper limit Cmax, the print preventing threshold C1 and the print allowing threshold C2 may be set based on, for example, a relationship between the photosensitive member surface temperature and a time shown as a curve 51 in FIG. 5, and stored in the non-volatile memory 270. FIG. 5 shows a temperature increase of the photosensitive member surface temperature during printing in the first embodiment. The origin of curves 51 and 52 in FIG. 5 corresponds to a state where the photosensitive member surface temperature is 28° C. The curve 51 shows a state of a temperature increase in a case where no particular countermeasure is provided against a temperature increase of the photosensitive member surface temperature. The curve 52 shows a state of a temperature increase in a case where a countermeasure is provided against a temperature increase of the photosensitive member surface temperature by a control by using the count value C described later. It is noted that the curves 51 and 52 in FIG. 5 are experimental values resulting from an experiment carried out in which the photosensitive member driving motor 220 is turned on from a state where the photosensitive member surface temperature is 28° C.

According to FIG. 5, it is possible to expect a time required for increasing the photosensitive member surface temperature or such. Therefore, in the first embodiment, according to the curves of an increase of the photosensitive member surface temperature, the count upper limit Cmax, the print preventing threshold C1 and the print allowing threshold C2 can be set. In the first embodiment, the count upper limit Cmax=2500, the print preventing threshold C1=2400 and the count allowing threshold C2 is 2040.

Below, the backgrounds of the count upper limit Cmax, the print preventing threshold C1 and the print allowing threshold C2 will be described.

According to the curve 51 of FIG. 5, when 40 minutes have elapsed since the photosensitive member driving motor 220 is turned on from a state where the photosensitive member surface temperature is 28° C., the photosensitive member surface temperature increases by approximately 15° C., and thus becomes 43° C. (15[° C.]+28[° C.]=43[° C.]). Therefore, for example, in a case where the count value C of the counting part 264 is incremented by 1 every second by the processing part 260, the photosensitive member surface temperature reaches 43° C. from 28° C. (an increase of 15° C.) while the count value C of the counting part 264 is incremented 2400 times (60 [sec]×40 [min]=2400 [sec]). In the first embodiment, an image defect may occur when the photosensitive member surface temperature reaches 44° C., for example. Therefore, a maximum temperature of the photosensitive member surface temperature is determined as 43° C., for example, for ensuring carrying out printing without causing an image defect, and it is determined that printing is prevented when the photosensitive member surface temperature reaches 43° C. The above-mentioned print preventing threshold C1=2400 corresponds to a time required for the photosensitive member surface temperature reaching 43° C. from 28° C. (an increase of 15° C.) in a case where, for example, the count value C of the counting part 264 is incremented by 1 every second (60 [sec]×40 [min]=2400 [sec]) by the processing part 260.

The count upper limit Cmax=2500 corresponds to a case where the count value C of the counting part 264 is incremented by 2 or more every second by the processing part 260, for example, and indicates that the photosensitive member surface temperature is 43° C. or more. The background of the print allowing threshold C2=2040 will be described later.

Returning to FIG. 4, the controller 210 gives a printing instruction for the processing part 260, or carries out image processing. The controller 210 transmits a printing request signal 211 that directs carrying out printing to the processing part 260. The printing request signal 211 is turned on and off once for one sheet of printing.

Further, the controller 210 transmits and receives a communication signal 212 with the processing part 260, which signal is for carrying out communications between the controller 210 and the processing part 260. It is noted that, the controller 210 in the first embodiment informs the processing part 260 of whether to carry out one-side printing or both-sides printing before turning on the printing request signal 211.

Further, the controller 210 receives from the processing part 260 a print allowing signal 213 indicating whether the image forming apparatus 100 is in a printing allowed state. The processing part 260 transmits the print allowing signal having a high level (referred to as an H level, hereinafter) when the image forming apparatus 100 is in the printing allowed state. Further, the processing part 260 in the first embodiment transmits the print allowing signal 213 having a low level (referred to as an L level, hereinafter) when the image forming apparatus 100 is in a printing not allowed state. That is, in the first embodiment, in a case where the print allowing signal 213 is turned on, a printing operation is allowed, and in a case where the print allowing signal 213 is turned off, a printing operation is not allowed. Therefore, in the first embodiment, when the image forming apparatus 100 receives a printing request and the printing request signal 211 is turned on, and also, the print allowing signal is turned on, the processing part 260 starts a printing operation. Then, in a case where the print allowing signal 213 is turned off during the printing operation, the processing part 260 interrupts the printing operation. Then, in a case where the print allowing signal 212 is turned on during the interruption of the printing operation, the processing part 260 re-starts the printing operation.

The photosensitive member driving motor 220 rotates (is turned on) when receiving a turning-on instruction from the processing part 260. When the photosensitive member driving motor 220 thus rotates, a driving force of the photosensitive member driving motor 220 is transmitted to the photosensitive member 121 and the developing unit 124 (including the developing units 124Bk, 124M, 124C and 124Y) by means of a driving force transmitting mechanism (not shown). The photosensitive member driving motor 220 stops (is turned off) when receiving a turning-off instruction from the processing part 260. When the photosensitive member driving motor 220 thus stops, the photosensitive member 121 and the developing unit 124 stop accordingly. In the first embodiment, during the photosensitive member driving motor 220 rotating, friction heat is generated in the photosensitive member 121 and the developing unit 124, and the photosensitive member surface temperature increases accordingly.

The temperature reducing part 230 is, for example, a fan motor for removing heat generated in the inside of the image forming apparatus 100. The temperature reducing part 230 is turned on and turned off under the control of the processing part 260 by receiving an operation instruction from the processing part 260. The temperature reducing part 230 starts operation (rotation) in response to receiving a turning-on instruction from the processing part 260, circulates heat accumulated in the image forming apparatus 100 or transfers the heat to the outside of the image forming apparatus 100 to reduce a temperature in the inside of the image forming apparatus 100.

The fixing temperature detecting part 240 is, for example, a thermistor that detects a temperature (temperature of a surface of a fixing roller (not shown)) of the fixing unit 160. The fixing temperature detecting part 240 always carries out the temperature detecting operation while the processing part 260 is operating. The external temperature measuring part 250 is a temperature sensor that is mounted on a housing of the image forming apparatus 100, and measures a temperature of the outside of the image forming apparatus 100.

Figure 6A:
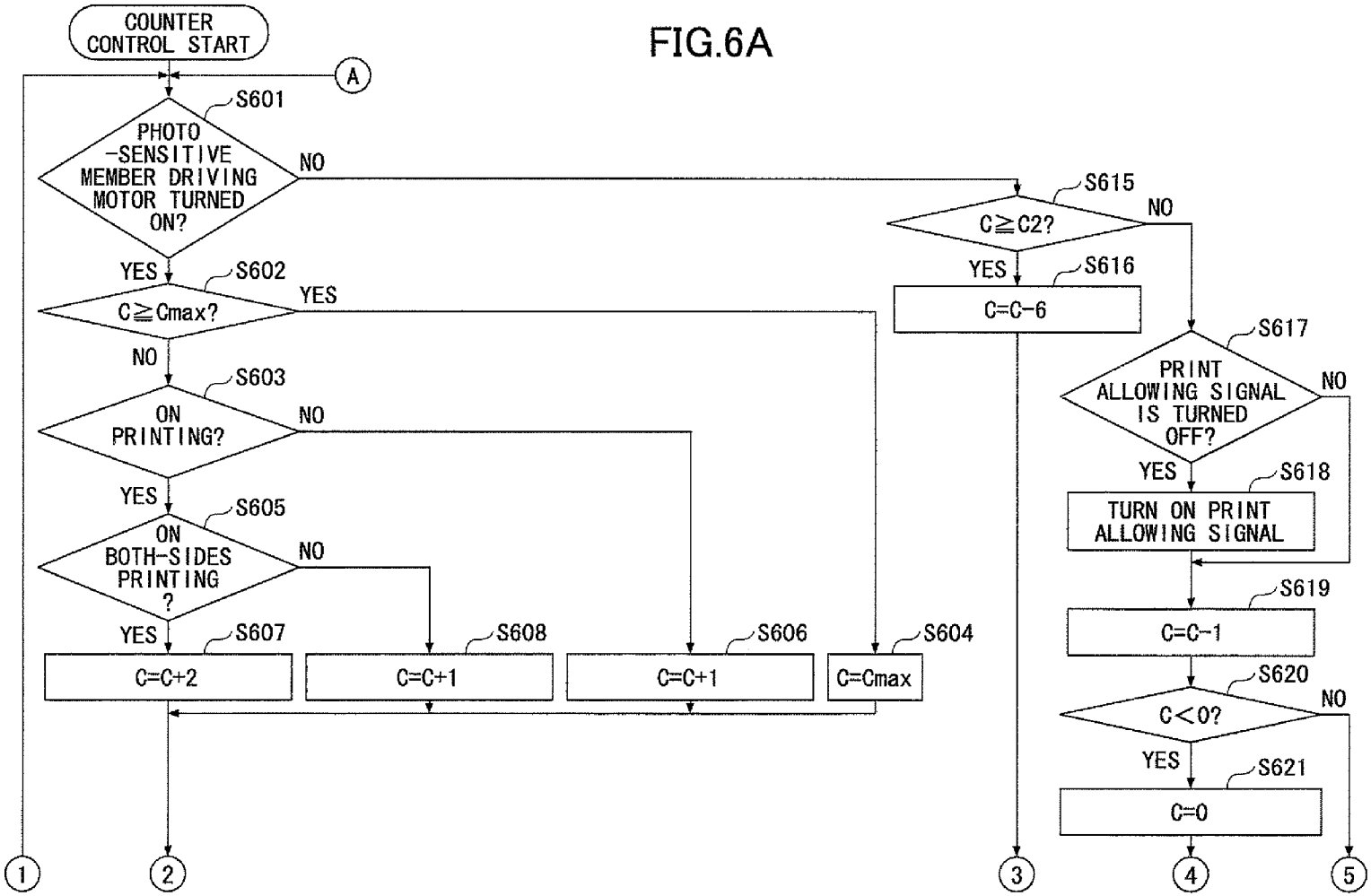
FIGS. 6A, 6B and 7 show a flowchart illustrating adding and subtracting operations of a count value (counter control process or control of interrupting a printing operation) in the first embodiment of the present invention.
Figure 6B:
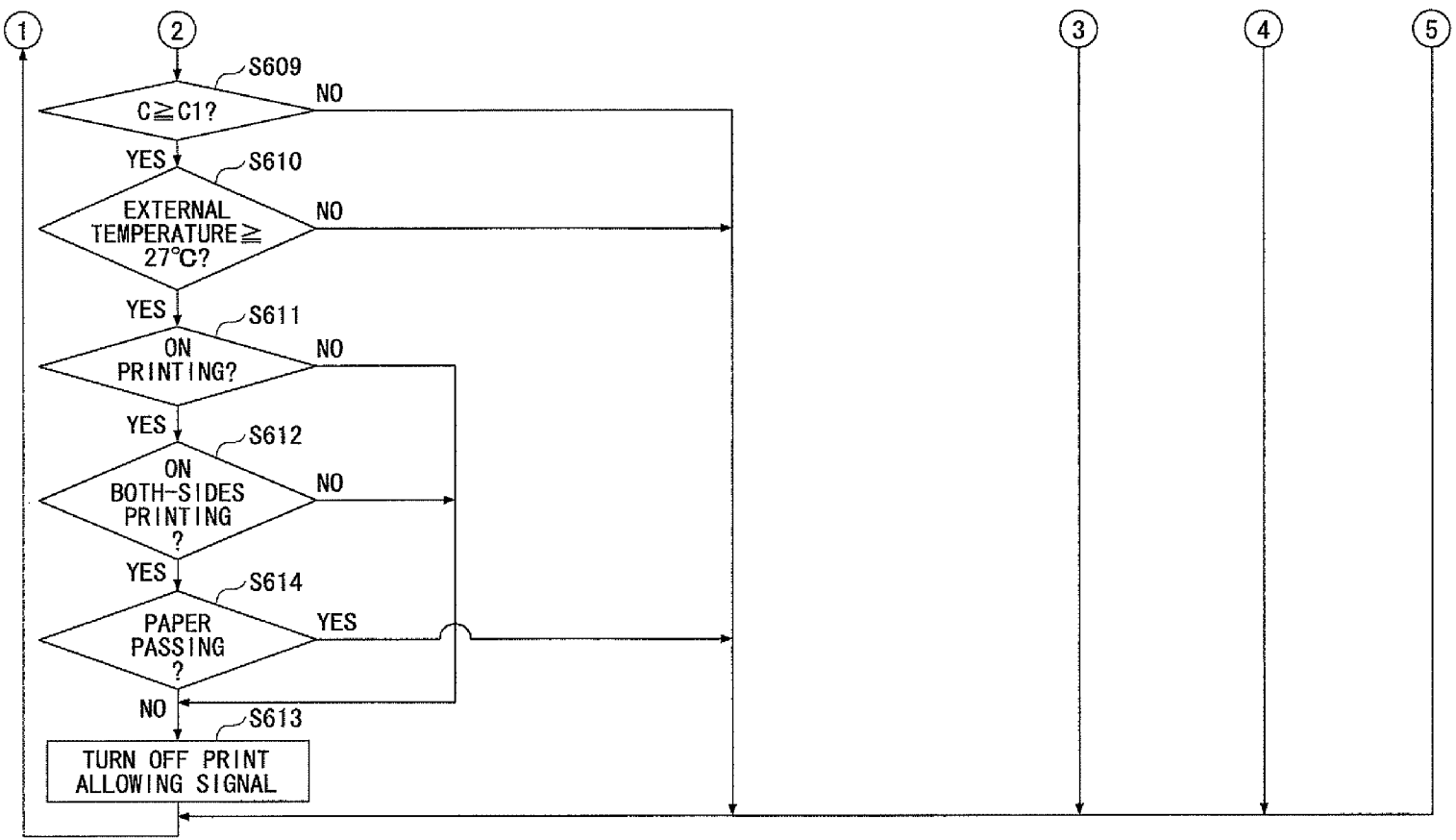

Next, with reference to FIGS. 6A-6B, incrementing and decrementing (adding and subtracting) of the count value C of the counting part 264 (counter control process or control of interrupting a printing operation) will be described. FIGS. 6A-6B shows a first flowchart for illustrating incrementing and decrementing the count value of the counting part 264 in the first embodiment. An operation shown in FIGS. 6A-6B is a loop operation repeatedly carried out every second after the image forming apparatus 100 is turned on.

In the image forming apparatus 100 in the first embodiment, the processing part 260 of the control mechanism 200 determines whether the photosensitive member driving motor 220 is turned on (step S601). In a case where the photosensitive member driving motor 220 is turned on, step S602 is carried out. In a case where the photosensitive member driving motor 220 is turned off (No) in step S601, step S615 is carried out.

In a case where the photosensitive member driving motor 220 is turned on, the processing part 260 determines whether the count value C of the counting part 264 is equal to or more than the count upper limit Cmax (step S602). In a case where the count value C of the counting part 264 is less than the count upper limit Cmax, the processing part 260 determines whether the image forming apparatus 100 is on a printing operation (step S603).

On the other hand, in a case where the count value C of the counting part 264 is equal to or more than the count upper limit Cmax in step S602, the processing part 260 rewrites the count value C of the counting part 264 with the count upper limit Cmax (step S604), and then, carries out step S609.

In a case where the image forming apparatus 100 is on a printing operation in step S603, the processing part 260 determines whether the printing operation is a both-sides printing operation (step S605). In a case where the image forming apparatus 100 is not on a printing operation in step S603, the processing part 260 obtains a new count value C from adding 1 to the current count value C of the counting part 264 (step S606), and proceeds to step S609.

In a case where the printing operation is a both-sides printing operation in step S605, the new count value C obtained from adding 2 to the current count value C of the counting part 264 is stored in the counting part 264 in step S607. In a case where the printing operation is not a both-sides printing operation in step S605, this means that the printing operation is a one-side printing operation, and the processing part 260 stores the new count value C obtained from adding 1 to the current count value C (step S608), and carries out step S609.

It is noted that factors of increasing the photosensitive member surface temperature include various factors. For example, a degree of an increase of the photosensitive member surface temperature is different between a case where no paper passing state occurs in the image forming apparatus 100 such as a case of a warming up operation, and a case where a paper passing state occurs in the image forming apparatus 100 such as a case of a printing operation. Further, in a case where a printing operation is carried out, a degree of an increase of the photosensitive member surface temperature is different between a case of one-side printing operation and a case of a both-sides printing operation, because a state of an air flow in the image forming apparatus 100 is different between the cases because of a structure of bristles (brush) or such provided in the image forming apparatus 100. Therefore, a timing at which an image defect occurs may vary in a nonuniform fashion.

An increase of the photosensitive member surface temperature is faster in an order of both-sides printing>one-side printing>warming up operation, and a decrease of the same is faster in the reverse order. This is because a paper sheet passing through the image forming apparatus 100 blocks an internal air exit hole, and thereby heat is accumulated in the image forming apparatus 100. In particular, in a both-sides printing operation, there is a case where two paper sheets simultaneously pass through the image forming apparatus 100 for the purpose that a printing speed is increased. Thus, heat is easily accumulated in the image forming apparatus 100, and as a result, the photosensitive member surface temperature rapidly increases. It is noted that in the flowchart of FIGS. 6A-6B, because an increment of the count value C is an integer, the increment in a case of one-side printing is 1 ("+1" in step S608), and also, the increment in a case of a warming up operation is 1 ("+1" in step S606).

Thus, the increment of the count value C of the counting part 264 varies according to an operation state of the image forming apparatus 100 (steps S606, S607 and S608). Thus, it is possible to increment the count value C more appropriately.

The processing part 260 determines whether the count value C stored in the counting part 264 is equal to or more than the print preventing threshold C1 (step S609).

In a case where the count value C is less than the print preventing threshold C1 in step S609, the processing part 260 finishes the current counter control process (or control of interrupting a printing operation) without turning off the print allowing signal 213.

In a case where the count value C is equal to or more than the print preventing threshold C1 in step S609, the processing part 260 measures a temperature of the outside of the image forming apparatus 100 by means of the external temperature measuring part 250, and determines whether the external temperature is equal to or more than 27° C. (step S610).

In a case where the external temperature is equal to or more than 27° C. in step S610, the processing part 260 again determines whether the image forming apparatus 100 is on a printing operation (step S611). In a case where the external temperature is less than 27° C. in step S610, the processing part 260 does not carry out the control of interrupting a printing operation. In the first embodiment, as shown in FIG. 5, the image forming apparatus 100 enters a state in which an image defect may occur when a predetermined time has elapsed from a state where the photosensitive member surface temperature is 28° C. Therefore, in a case where the photosensitive member surface temperature is less than 27° C., a likelihood of an image defect occurring is low. Normally, the photosensitive member surface temperature is higher than the external temperature because respective devices in the image forming apparatus 100 generate heat.

In consideration of the above, the control of interrupting a printing operation is not carried out in a case where the external temperature is less than 27° C. as mentioned above because a likelihood of the photosensitive member surface temperature reaching the above-mentioned 43° C. is low in this case, in the first embodiment.

In a case where the image forming apparatus 100 is on a printing operation in step S611, the processing part 260 determines whether the printing operation is a both-sides printing operation or a one-side printing operation (step S612). In a case where the image forming apparatus 100 is not on a printing operation in step S611, the processing part 260 turns off the print allowing signal 213 and prevents a printing operation (step S613).

In a case where the processing part 260 determines that the printing operation is a both-sides printing operation in step S612, the processing part 260 determines whether a paper passing state occurs in the image forming apparatus 100 (step S614). In a case where the printing operation is not a both-sides printing operation in step S612, this means that the printing operation is a one-side printing operation, and step S613 is carried out. In step S613, the print allowing signal 213 is turned off, and the printing operation is interrupted.

In a case where no paper passing state occurs in the image forming apparatus 100 in step S614, the processing part 260 turns off the print allowing signal 213 and interrupts a printing operation in step S613. In a case where a paper passing state occurs in the image forming apparatus 100 in step S614, the processing part 260 finishes the current counter control process (or control of interrupting a printing operation) without turning off the print allowing signal so that the currently processed image forming operation is allowed to continue.

In a case where the photosensitive member driving motor 220 is turned off in step S601, the processing part 260 determines whether the count value C of the counting part 624 is equal to or more than the print allowing threshold C2 (step S615). In a case where the count value C is equal to or more than the print allowing threshold C2 in step S615, this means that a difference between the photosensitive member surface temperature and an external temperature is large, and therefore, the photosensitive member surface temperature decreasing speed is high. Therefore, the processing part 260 subtracts "6" (relatively large amount) from the count value C (step S616), and finishes the current counter control process (or control of interrupting a printing operation) without turning off the print allowing signal.

It is noted that, in the first embodiment, the reason for the above-mentioned print allowing threshold C2=2040 is as follows: A situation is assumed in which 1 minute (60 seconds) has elapsed from a state where the photosensitive member surface temperature is at the printing preventing threshold C1=2400, in a condition in which the photosensitive member surface temperature decreasing speed is high as mentioned above (corresponding to the above-mentioned subtraction of "6" from the count value C). In this situation, a decrease in the photosensitive member surface temperature corresponds to 6×60 [sec]=360. Therefore, the resulting photosensitive member surface temperature corresponds to 2400−360=2040. In a case where the photosensitive member surface temperature decreases from the print preventing threshold C1=2400 to become the above-mentioned print allowing threshold C1=2040, it is expected that the photosensitive member surface temperature becomes equal to or less than the above-mentioned 43° C. even in a case where the photosensitive member surface temperature decreasing speed is a normal one, and thus, a printing operation can be allowed to be carried out. Thus, the print allowing threshold C1=2040 is determined.

In a case where the count value C of the counting part 264 is less than the print allowing threshold C2 in step S615, the processing part 260 determines whether the print allowing signal is turned off (step S617).

In a case where the print allowing signal 213 is turned off in step S617, the processing part 260 turns on the print allowing signal 213 (step S618). In a case where the print allowing signal 213 is turned on in step S617, the processing part 260 proceeds to step S619.

When the print allowing signal is turned on, the processing part 260 subtracts 1 from the count value C of the counting part 264 (step S619). Next, the processing part 260 determines whether the count value C is less than 0 (step S620). In a case where the count value C is less than 0, the processing part 260 changes the count value C to 0 (step S621), and finishes the current counter control process (or control of interrupting a printing operation). In a case where the count value C is equal to or more than 0, the processing part 260 finishes the current counter control process (or control of interrupting a printing operation).

In the first embodiment, as described above, it is possible to make the rate of the photosensitive member surface temperature increase be relatively small, as indicated by a curve 52 of FIG. 5, by controlling the count value C of the counting part 264. Further, as shown in FIG. 5, the photosensitive member surface temperature enters a balanced state at a temperature of 43° C. (=28+15), and thus, does not reach 44° C. at which an image defect may occur as mentioned above, even when a continuous printing operation is carried out.

This is because an amount (increment) added to the count value C in steps S606 through S608 is set such that a slope steeper than an actual slope of the photosensitive member surface temperature increase is set. The amount (increment) of adding to the count value C in the first embodiment is set as a value that is larger than a value corresponding to the photosensitive member surface temperature increase every second, for example. Therefore, by thus controlling an interruption of a printing operation according to the count value C as in the first embodiment, it is possible to achieve a control based on the photosensitive member surface temperature increase that has a slope steeper than an actual slope of the photosensitive member surface temperature increase.

Further, in the first embodiment, the photosensitive member surface temperature is made to decrease by turning off the print allowing signal 213 to interrupt a printing operation since a printing operation is interrupted until the count value C becomes the print allowing threshold C2=2040. Thus, the photosensitive member surface temperature falls during the count value C being thus decreased. Therefore, in the first embodiment, it is possible to always keep the photosensitive member surface temperature at a temperature at which no image defect occurs.

It is noted that, in the image forming apparatus 100 in the first embodiment, even in a case where, in step S613 of FIGS. 6A-6B, the print allowing signal 213 is turned off, and a printing operation is interrupted, an original reading operation may be continued as a result of the controller 210 transmitting an original reading instruction to an original reading device (not shown). In the first embodiment, in this case, the original reading device is configured to be controllable solely and separately from the image forming apparatus, and carries out an original reading operation in response to the original reading instruction given by the controller 210. Therefore, only an operation of reading an original (paper sheet) can be carried out in advance regardless of an operation of the image forming apparatus 100.

Figure 7:
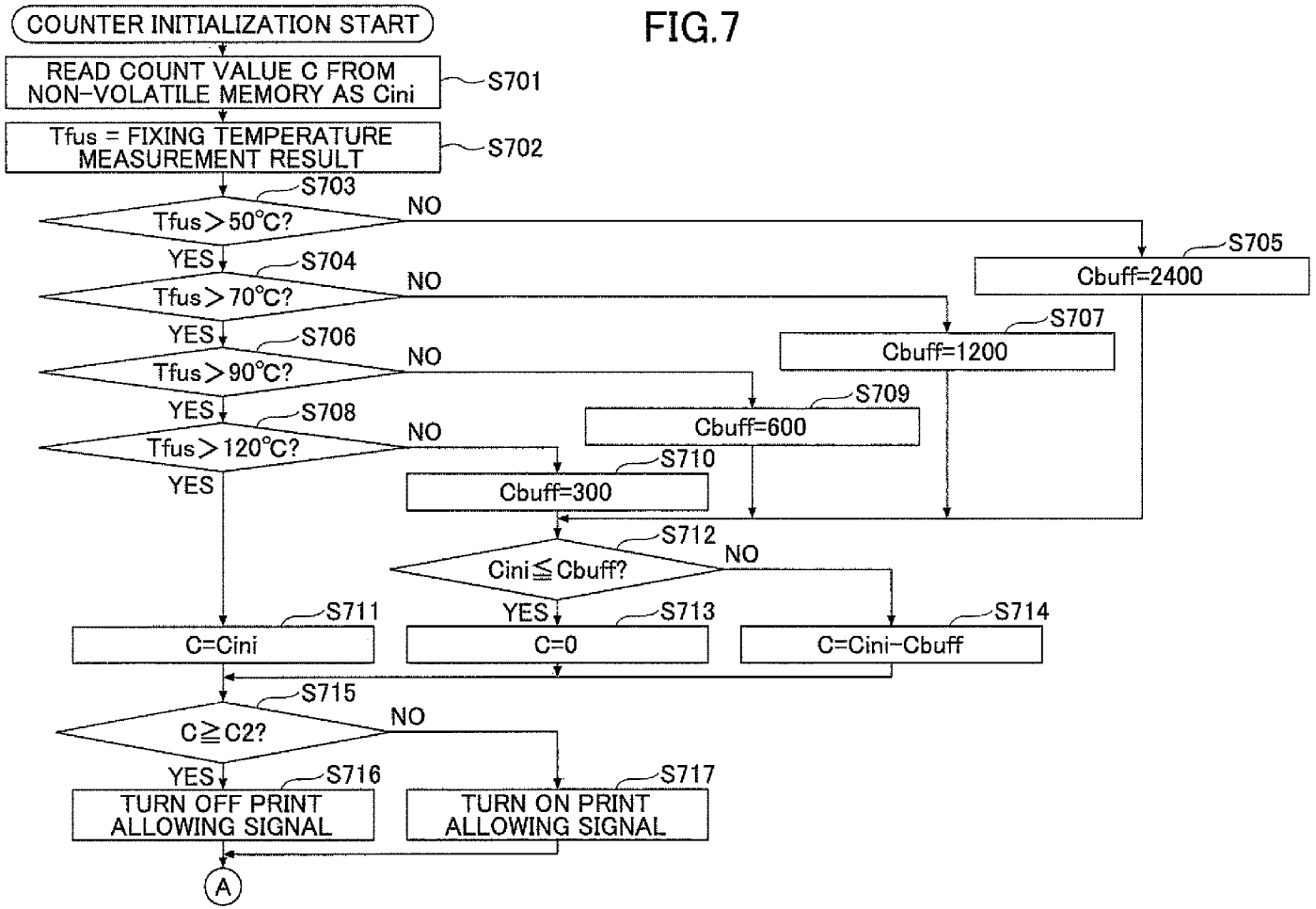

Next, with reference to FIG. 7, another operation of adding to and subtracting from (incrementing and decrementing) the count value C in the image forming apparatus 100 in the first embodiment. FIG. 7 shows a second flowchart illustrating adding to and subtracting from the count value C in the first embodiment. A process of FIG. 7 is carried out once when a power supply is started in the image forming apparatus 100 and when the image forming apparatus 100 returns from the energy saving mode such as the sleep mode. In the first embodiment, when the process of FIG. 7 is finished, a loop operation (once per second) of the above-described process of FIGS. 6A-6B is started.

In the process of FIG. 7, a time elapsed since a power supply in the image forming apparatus 100 is turned off or when the energy saving mode is started is expected due to a temperature change of the fixing unit 160, and a thus-expected time is reflected in the count value C.

The processing part 260 stores in a counter initial value storing buffer Cini the count value C that has been stored in the non-volatile memory 270 (step S701). The count value C stored in the non-volatile memory 270 is the count value C obtained when a power supply is turned off in the image forming apparatus 100 or the energy saving mode is started. Next, the processing part 260 stores in the fixing temperature storing buffer Tfus provided in the RAM 262 a fixing temperature detected by the fixing temperature detecting part 240 (step S702).

The processing part 260 stores in a count value calculating buffer Cbuff a count value corresponding to the temperature stored in the fixing temperature storing buffer Tfus in steps S703 through S710. For example, the processing part 260 determines whether the temperature in the fixing temperature storing buffer Tfus is higher than 50° C. (step S703). In a case where the temperature in the fixing temperature storing buffer Tfus is higher than 50° C., the processing part 260 proceeds to step S704. In a case where the temperature in the fixing temperature storing buffer Tfus is equal to or less than 50° C., the processing part 260 stores 2400 in the count value calculating buffer Cbuff provided in the RAM 262, and proceeds to step S712.

The processing part 260 carries out the same process also in steps S704 through S710.

In a case where the temperature in the fixing temperature storing buffer Tfus is higher than 120° C., the processing part 260, it is determined that a time having elapsed since the power supply was turned off or the energy saving mode was started is very small, and thus, this time is not considered. Therefore, in this case, the processing part 260 reflects the value of the counter initial value storing buffer Cini in the count value C (step S711).

The processing part 260 determines a relationship between the respective values in the counter initial value storing buffer Cini and the counter calculating buffer Cbuff (step S712).

In a case where the value in the counter initial value storing buffer Cini is equal to or less than the value in the count value calculating buffer Cbuff in step S712, the processing part 260 sets 0 in the count value C (step S713), and proceeds to step S715. In a case where the value in the counter initial value storing buffer Cini is larger, the processing part 260 sets in the counter value C a difference between the value in the counter initial value storing buffer Cini and the value in the count value calculating buffer Cbuff (step S714), and proceeds to step S715.

The processing part 260 determines whether the count value C is equal to or more than the print allowing threshold C2 (step S715). In a case where the count value C is equal to or more than the print allowing threshold C2, the processing part 260 turns off the print allowing signal 213, and interrupts a printing operation by the controller 210 (step S716). In a case where the count value C is less than the print allowing threshold C2, the processing part 260 turns on the print allowing signal 213, and allows a printing operation by the controller 210 (step S717). After completing step S716 or S717, the processing part 260 carries out the process of FIGS. 6A-6B from step S601.

Figure 8:
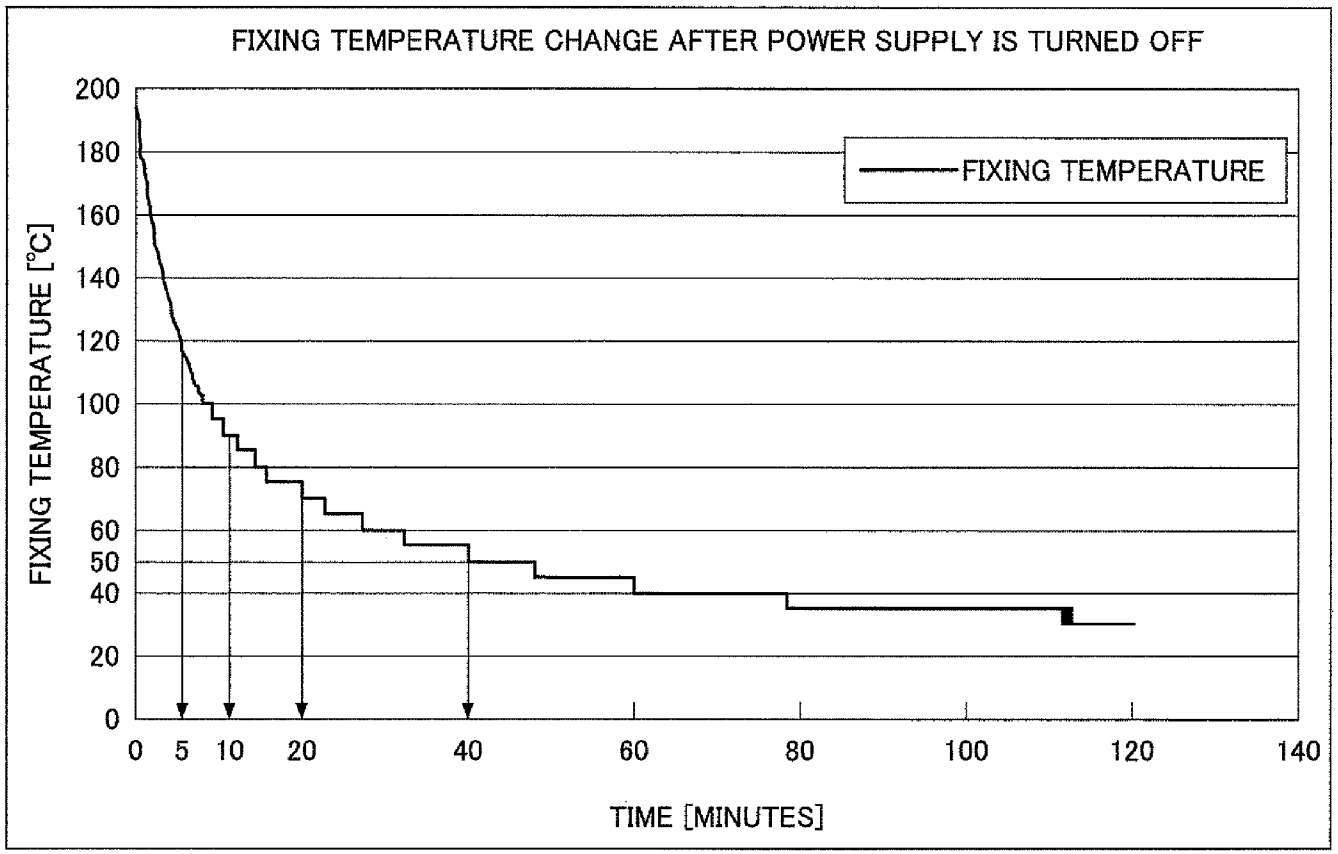
FIG. 8 shows a fixing temperature change after a power supply is turned off.

FIG. 8 shows a fixing temperature change after a power supply in the image forming apparatus 100 is turned off. For example, it is assumed that a fixing temperature of the fixing unit 160 in the first embodiment is 200° C. In this case, as shown in FIG. 8, it is seen that, when the fixing temperature at a time of a power supply being turned on in the image forming apparatus 100 is 120° C., 5 minutes have elapsed since a power supply was turned off in the image forming apparatus 100. Similarly, it is seen that, when the fixing temperature at a time of a power supply being turned on in the image forming apparatus 100 is 90° C., 10 minutes have elapsed since a power supply was turned off in the image forming apparatus 100. In the first embodiment, a subtracting amount corresponding to a time having elapsed since a power supply was turned off or the energy saving mode was started is reflected in the count value C stored before a power supply was turned off or the energy saving mode was started.

That is, from FIG. 8, it is seen that, in a case where the fixing temperature is 50° C. (step S703), a time having elapsed since a power supply was turned off or the energy saving mode was started is 40 minutes. Therefore, the count value C is set to be a value obtained from subtracting 40×60 [sec]=2400 (Cbuff) from the count value C (Cini) obtained when a power supply was turned off or the energy saving mode was started (steps S705 S712 and S714). The same method is applied for the other fixing temperatures 70° C., 90° C. and 120 (steps S704, S706 and S708).

The photosensitive member surface temperature depends on heat generated at a time of fixing a toner image onto a paper sheet. Therefore, in the first embodiment, a state of the fixing temperature is reflected in the count value. Thus, it is possible to determine a state of the photosensitive member surface temperature appropriately even when a power supply is turned off and on in the image forming apparatus 100, or the power saving mode is started and the image forming apparatus 100 returns from the power saving mode.

Figure 9:
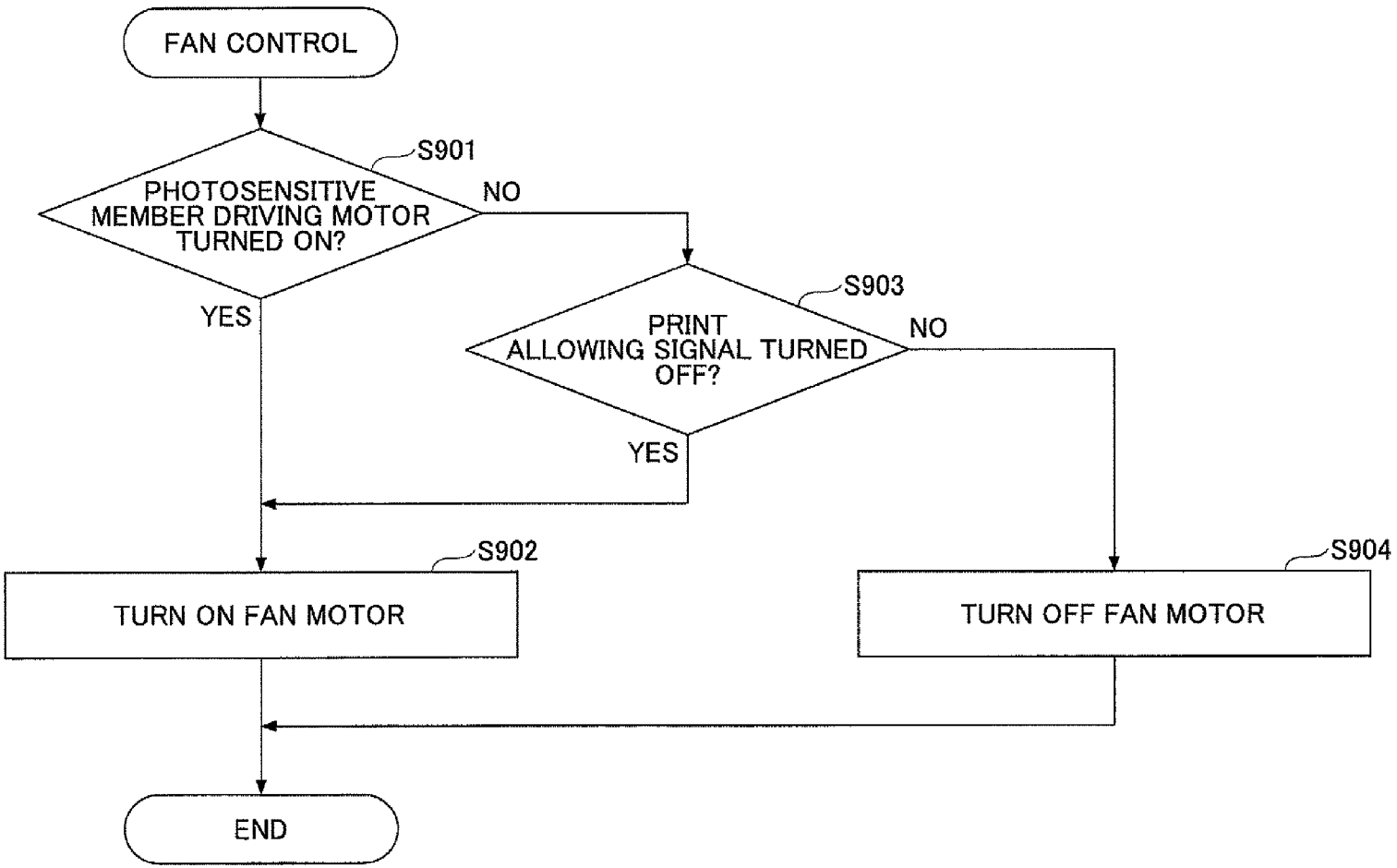
FIG. 9 shows a flowchart illustrating a control carried out by a temperature reducing part 230 in the first embodiment of the present invention.

Next, with reference to FIG. 9, a control carried out by the temperature reducing part 230 will be described. FIG. 9 shows a flowchart illustrating a control carried out by the temperature reducing part 230.

The temperature reducing part in the first embodiment is a fan motor or such that removes heat from the inside of the image forming apparatus 100. The control of FIG. 9 is carried out every 5 milliseconds.

In the image forming apparatus 100 in the first embodiment, the processing part 260 determines whether the photosensitive member driving motor 220 is turned on (step S901). In a case where the photosensitive member driving motor 220 is turned on in step S901, the processing part 260 turns on the temperature reducing part 230 (referred to as a fan motor 230, hereinafter) (step S902).

In a case where the photosensitive member driving motor 220 is turned off in step S901, the processing part 260 determines whether the print allowing signal 213 is turned off (step S903). In a case where the print allowing signal 213 is turned off in step S903, the processing part 260 proceeds to step S902, and turns on the fan motor 230. It is noted that, in a case where both the photosensitive member driving motor 220 is turned off and the print allowing signal 213 is turned off, there is a possibility that the internal temperature of the image forming apparatus 100 increases. Therefore, in the first embodiment, the fan motor 230 is turned on in a case where both the photosensitive member driving motor 220 is turned off and the print allowing signal 213 is turned off, so that the temperature in the inside of the image forming apparatus 100 is reduced.

In a case where the print allowing signal 213 is turned on in step S903, the processing part 260 turns off the fan motor 230 (step S904).

Thus, in the first embodiment, based on whether the print allowing signal 213 is turned on or off, a control of turning on and off of the fan motor 230 is carried out. Thereby, it is possible to control the fan motor 230 according to a state of the image forming apparatus 100 for when the photosensitive member driving motor 220 is turned off. That is, according to the first embodiment, in a case where both the photosensitive member driving motor 220 is turned off and the print allowing signal 213 is turned off, it is seen that the photosensitive member driving motor 220 is thus turned off probably because of an increase in a temperature of the inside of the image forming apparatus 100. Therefore, the processing part 260 turns on the fan motor 230 (steps S901, S903 and S902).

Further, in a case where both the photosensitive member driving motor 220 is turned off and the print allowing signal 213 is turned on, it is seen that the photosensitive member driving motor 220 is turned off because a printing request is not given. Therefore, the processing part 260 turns off the fan motor 230 (steps S901, S903 and S904). It is noted that, in the image forming apparatus 100 in the first embodiment, the print allowing signal 213 is turned on in a standing by state in a normal condition.

By the above-mentioned control, it is possible to reduce the photosensitive member surface temperature by driving the fan motor 230 and removing heat from the inside of the image forming apparatus 100, only in a case where the print allowing is turned off (steps S901, S903 and S902).

Figure 10:
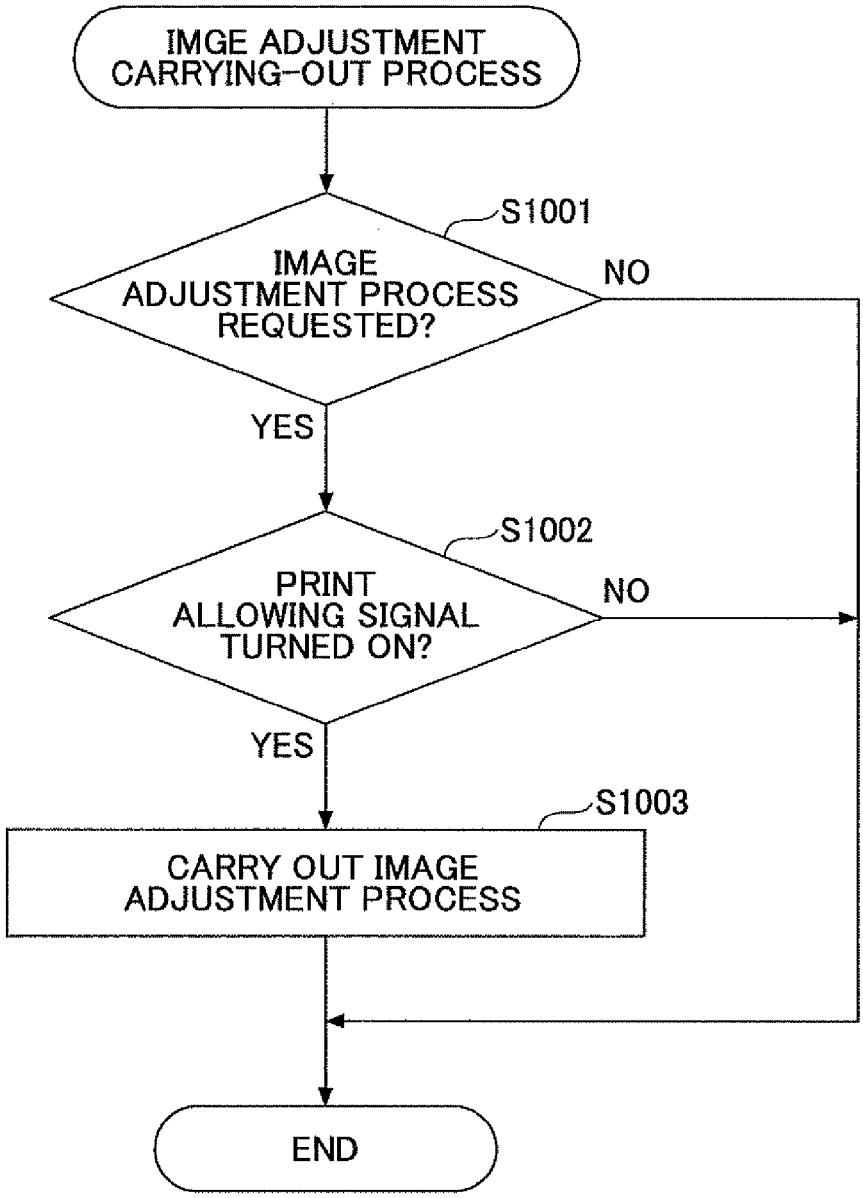
FIG. 10 shows a flowchart illustrating an image adjusting process in the first embodiment of the present invention.

Next, with reference to FIG. 10, a control of an image adjustment process in the first embodiment will be described. FIG. 10 shows a flowchart illustrating a control of an image adjustment process in the first embodiment.

The image adjustment process in the first embodiment described below is a process of detecting a change in image forming process conditions caused by a change in a temperature and/or humidity, optimizing the process conditions, and providing stable images. The image adjustment process is, for example, such that, when a change in a temperature and/or humidity in the image forming apparatus 100 is detected, the controller 210 outputs an image adjustment process carrying-out request to the control mechanism 200.

Normally, when the image adjustment process is carried out in a case where the photosensitive member surface temperature is high, an image may be distorted. Therefore, in the image forming apparatus 100 in the first embodiment, the image adjustment process is prevented in a case where the photosensitive member surface temperature is high. The process of FIG. 10 is started up and carried out every 5 milliseconds.

In the image forming apparatus 100 in the first embodiment, the processing part 260 determines whether an image adjustment process carrying-out request is given (step S1001). In a case where no image adjustment process carrying-out request is given in step S1001, the processing part 260 finishes the current process of FIG. 10.

In a case where an image adjustment process carrying-out request is given in step S1001, the processing part 260 determines whether the print allowing signal 213 is turned on (step S1002). In a case where the print allowing signal 213 is turned on in step S1002, the processing part 260 carries out an image adjustment process (step S1003). In a case where the print allowing signal 213 is turned off in step S1002, the processing part 260 finishes the current process of FIG. 10.

In the first embodiment, the print allowing signal is turned off so that the photosensitive member surface temperature does not become higher than the threshold (step S613 of FIG. 6B). Therefore, in the first embodiment, in a case where an image adjustment process carrying-out request is given, the image adjustment process is carried out only when the print allowing signal is turned on (steps S1001, S1002 and S1003). Thereby, it is possible to prevent the image adjustment process from being carried out in a case where the photosensitive member surface temperature is high.

Figure 11:
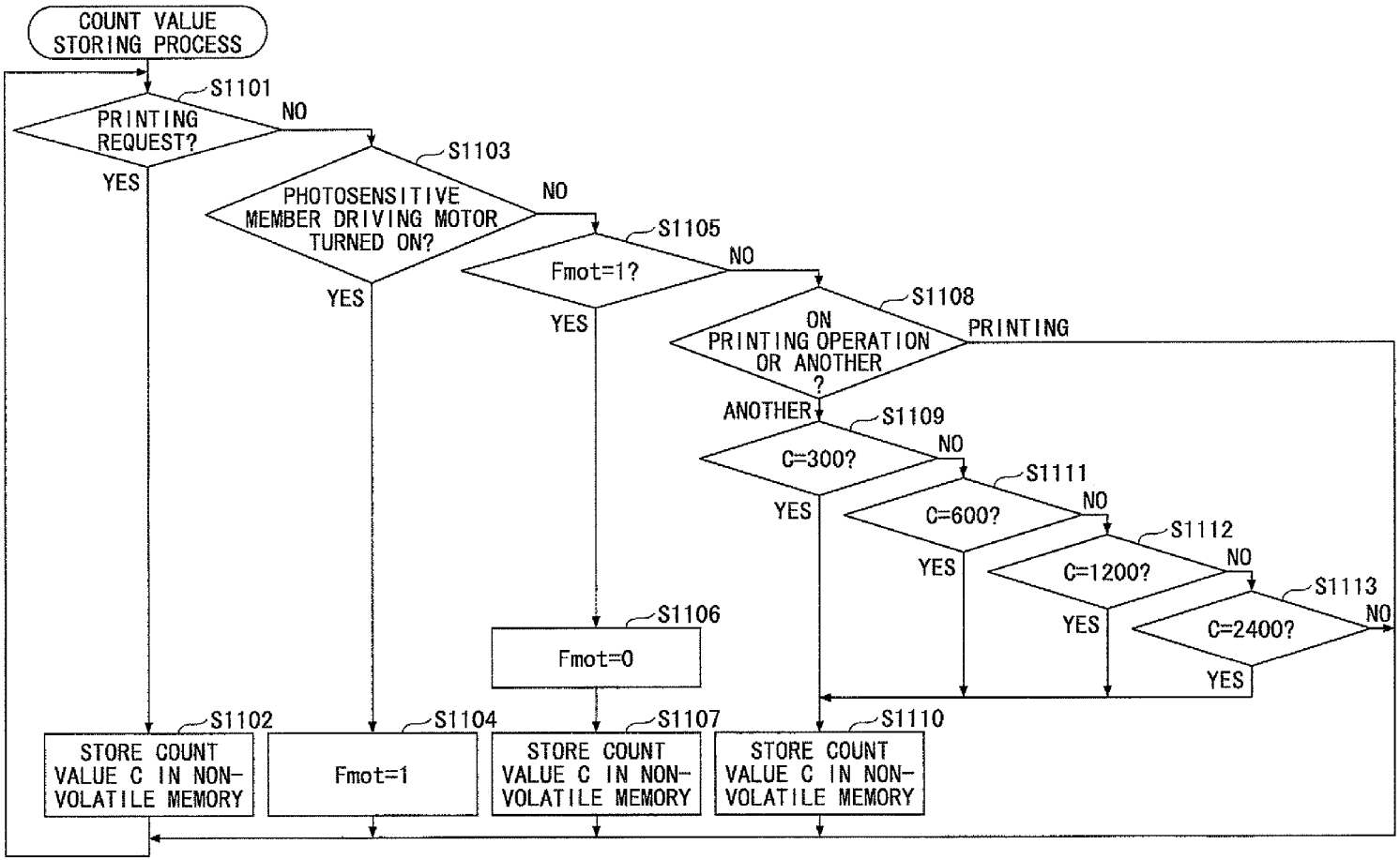
FIG. 11 shows a flowchart illustrating a process of storing the count value C in a non-volatile memory 270 in the first embodiment of the present invention.

Next, with reference to FIG. 11, a process of storing in the non-volatile memory 270 the count value C of the counting part 264 in the first embodiment will be described. FIG. 11 shows a flowchart illustrating a process of storing in the non-volatile memory 270 the count value C of the counting part 264. The process of FIG. 11 described below is started up and carried out every second.

In the image forming apparatus 100 in the first embodiment, the processing part 260 determines whether the printing request signal 211 from the controller 210 is turned on (step S1101). In a case where the printing request signal 211 is turned on in step S1101, the processing part 260 stores the count value C in the non-volatile memory 270 (step S1102). In a case where the printing request signal 211 is turned off in step S1101, the processing part 260 determines whether the photosensitive member driving motor 220 is turned on (step S1103).

In a case where the photosensitive member driving motor 220 is turned on in step S1103, the processing part 260 sets (1) a photosensitive member driving motor on flag Fmot (step S1104). In a case where the photosensitive member driving motor 220 is turned off in step S1103, the processing part 260 determines whether the photosensitive member driving motor on flag Fmot is set (step S1105).

In a case where the photosensitive member driving motor on flag Fmot is set in step S1105, the processing part 260 resets (0) the photosensitive member driving motor on flag Fmot (step S1106). Then, the processing part 260 stores the count value C in the non-volatile memory 270 (step S1107).

In a case where the photosensitive member driving motor on flag Fmot is not set in step S1105, the processing part 260 determines whether the image forming apparatus 100 currently carries out a printing operation or another operation (step S1108). It is noted that, another operation is, for example, a warming up operation, an error processing operation, an operation in the standing by mode or such.

In a case where the image forming apparatus 100 carries out another operation in step S1108, the processing part 260 determines whether the count value C is 300 (step S1109). In a case where the count value C is 300 in step S1109, the processing part 260 stores the count value in the non-volatile memory 270 (step S1110). In a case where the image forming apparatus 100 carries out a printing operation in step S1108, the processing part 260 finishes the process of storing the count value C.

In a case where the count value C is not 300 in step S1109, the processing part 260 determines whether the count value C is 600 (step S1111). In a case where the count value C is 600 in step S1111, the processing part 260 proceeds to step S1110.

In a case where the count value C is not 600 in step S1111, the processing part 260 determines whether the count value C is 1200 (step S1112). In a case where the count value C is 1200 in step S1112, the processing part 260 proceeds to step S1110.

In a case where the count value C is not 1200 in step S1112, the processing part 260 determines whether the count value C is 2400 (step S1113). In a case where the count value C is 2400 in step S1113, the processing part 260 proceeds to step S1110. In a case where the count value C is not 2400 in step S1113, the processing part 260 finishes the process of storing the count value C.

In the first embodiment, through the above-described process of FIG. 11, the count value C of the counting part 264 can be stored in the non-volatile memory 270.

Figure 12:
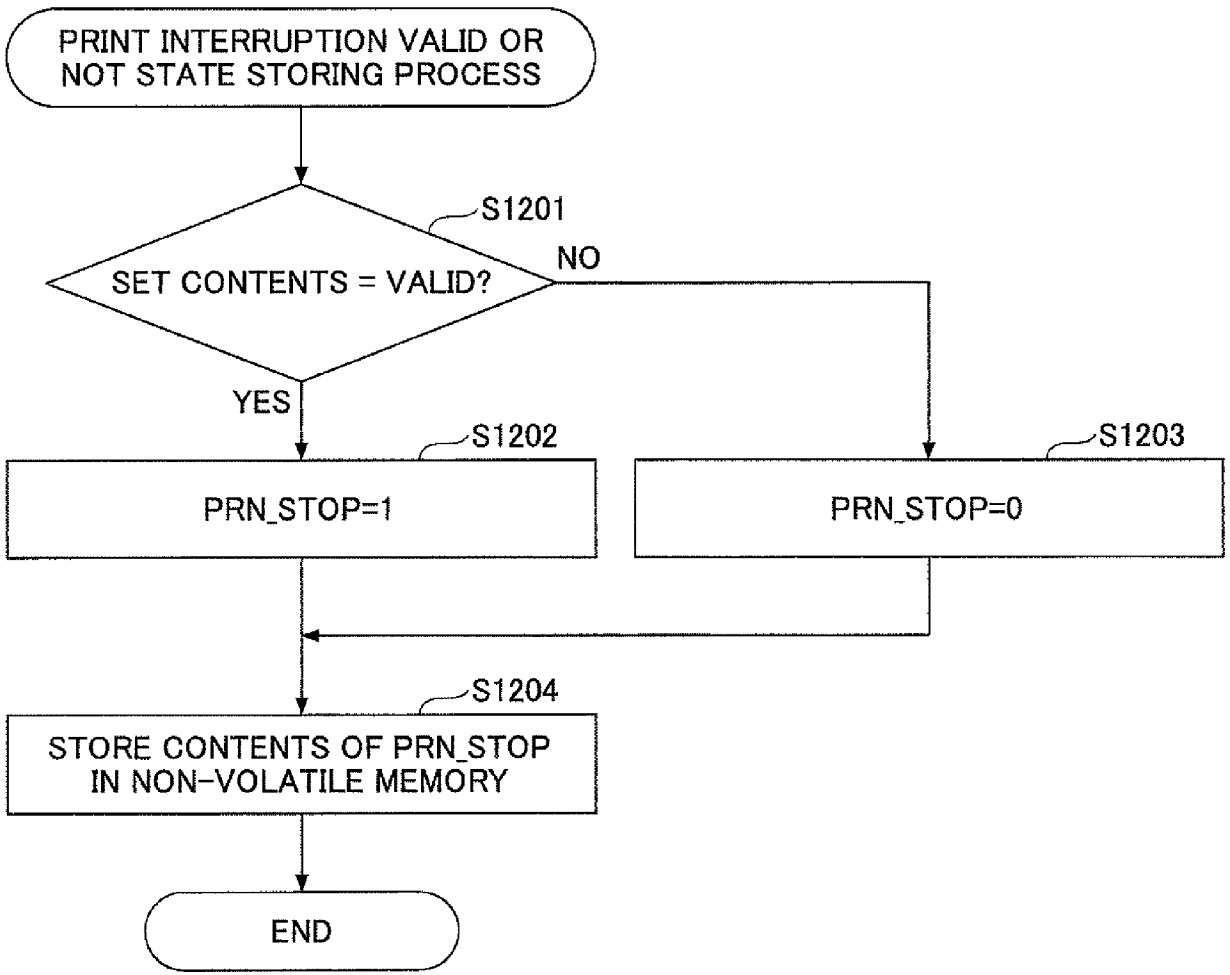
FIG. 12 shows a flowchart illustrating a setting for an interruption of a printing operation in the first embodiment of the present invention.

Further, in the image forming apparatus 100 in the first embodiment, it is possible not to make valid an operation of interrupting a printing operation using the count value C of the counting part 264. In the image forming apparatus 100 in the first embodiment, it is set whether an operation of interrupting a printing operation is valid, by using a communication signal 212 received from the controller 210. Below, with reference to FIG. 12, a process of setting whether an operation of interrupting a printing operation is valid will be described. FIG. 12 shows a flowchart illustrating a process of setting whether an operation of interrupting a printing operation is valid. The process described with reference to FIG. 12 is started up and carried out when the processing part 260 receives from the controller 120 a notification of whether an operation of interrupting a printing operation is valid, through the communication signal 212. The setting of whether an operation of interrupting a printing operation is valid is carried out, for example, by a user.

In the image forming apparatus 100 in the first embodiment, the processing part 260 determines whether setting contents reported through the communication signal 212 from the controller 210 indicate a setting that makes valid an operation of interrupting a printing operation (step S1201). In a case where the setting contents indicate a setting that makes valid an operation of interrupting a printing operation in a step S1201, the processing part 260 substitutes 1 for PRN_STOP that is a storage area secured in the RAM 262 (step S1202). In a case where the setting contents indicate a setting that does make valid an operation of interrupting a printing operation in a step S1201, the processing part 260 substitutes 0 for PRN_STOP that is a storage area secured in the RAM 262 (step S1203). The processing part 260 stores the value of PRN_STOP stored in the RAM 262 in the non-volatile memory 270 (step S1204).

Figure 13:
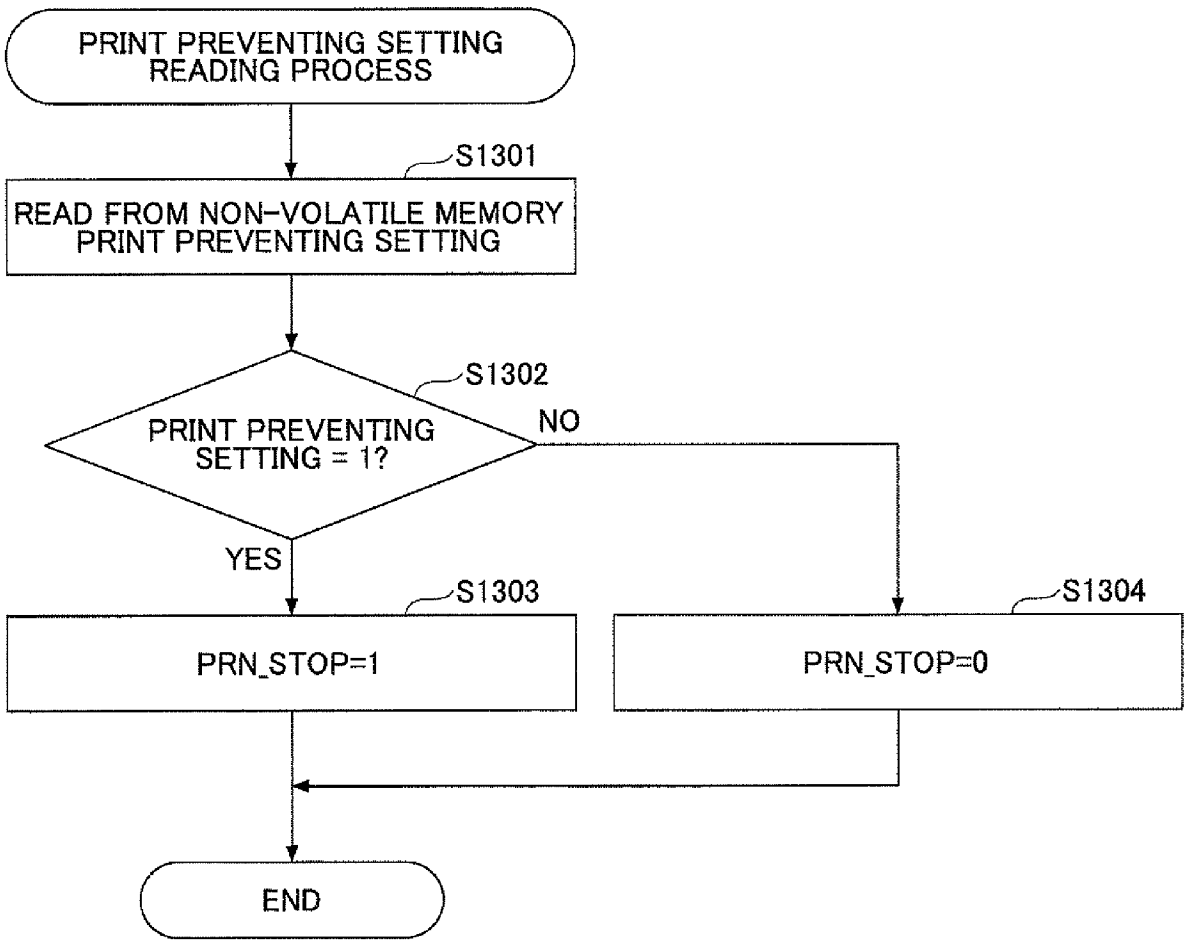
FIG. 13 shows a flowchart illustrating a process of reading the setting for an interruption of a printing operation in the first embodiment of the present invention.

Next, with reference to FIG. 13, a process of reading a setting of whether to make valid an operation of interrupting a printing operation will be described. FIG. 13 shows a flowchart illustrating a process of reading a setting of whether to make valid an operation of interrupting a printing operation in the embodiment. A process described with reference to FIG. 13 is carried out only once immediately after a power supply is started in the image forming apparatus 100 and when the image forming apparatus 100 returns from the energy saving mode such as the sleep mode.

In the image forming apparatus 100, the processing part 260 reads from the non-volatile memory 270 the contents of a setting of whether to make valid an operation of interrupting a printing operation (step S1301). It is noted that the contents of a setting of whether to make valid an operation of interrupting a printing operation are the value of PRN_STOP stored in the non-volatile memory 270 in step S1204 of FIG. 12. The processing part 260 determines whether the read setting of whether to make valid an operation of interrupting a printing operation indicates to make valid (1) an operation of interrupting a printing operation (step S1302).

In a case where the setting indicates to make valid (1) in step S1302, the processing part 260 substitutes 1 for PRN_STOP secured in the RAM 262 (step S1303). In a case where the setting indicates not to make valid (1) in step 1302, the processing part 260 substitutes 0 for PRN_STOP secured in the RAM 262 (step S1304).

As described above, in the image forming apparatus 100 in the first embodiment, a control is carried out by the processing part 260 such that, based on the count value C of the counting part 264, it is determined whether to interrupt a printing operation. Therefore, in the image forming apparatus 100 in the first embodiment, it is possible to interrupt a printing operation according to the photosensitive member surface temperature without providing a temperature sensor. Thus, it is possible to avoid an image defect otherwise occurring because of an increase in the photosensitive member surface temperature, at low cost. Further, in the first embodiment, it is possible to shorten an interruption time (downtime), for every interruption occurring, of a printing operation being interrupted by the above-mentioned operation of interrupting a printing operation. Thus, it is possible to avoid degradation in productivity otherwise occurring because of a long interruption operation. This advantage is particularly effective for such a low-end user that the number of printing sheets every time is small.

Second Embodiment

With reference to the figures, a second embodiment of the present invention will now be described. The second embodiment of the present invention is different from the above-described first embodiment in that a device type of the image forming apparatus 100 is considered. Therefore, in a description of the second embodiment below, only points different from the first embodiment will be described. For parts/components having the same functional configurations as those in the first embodiment, the same reference numerals as those in the first embodiment are given, and duplicate description thereof will be omitted.

In the second embodiment, a device type of the image forming apparatus 100 is determined. In the image forming apparatus 100 in the second embodiment, device type information indicating a device type of the image forming apparatus 100 is written in the non-volatile memory 270 when the image forming apparatus 100 is shipped from a factory. The device type information in the second embodiment is information indicating whether the image forming apparatus 100 is a multi-function peripheral (MFP) that has functions including a printing function and also those other than a printing function, or a printer that has a printing function only.

Figure 14:
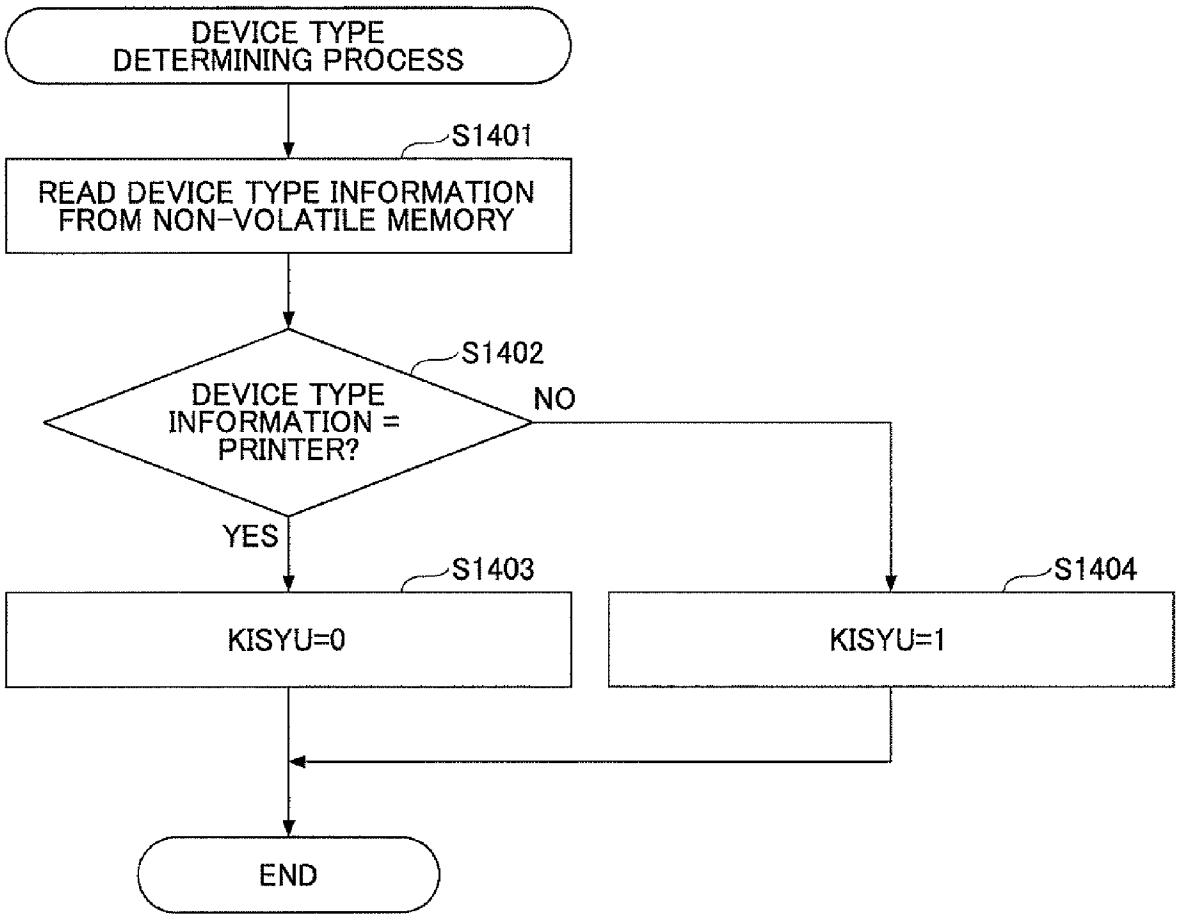
FIG. 14 shows a flowchart illustrating a process of determining a device type of an image forming apparatus 100 in a second embodiment of the present invention.

FIG. 14 shows a flowchart illustrating a process of determining a device type of the image forming apparatus 100 in the second embodiment. The process of FIG. 14 is carried out only once immediately after a power supply is started in the image forming apparatus 100 and when the image forming apparatus 100 returns from the energy saving mode such as the sleep mode.

The processing part 260 in the second embodiment reads the device type information from the non-volatile memory 270 (step S1401). The processing part 260 determines whether the image forming apparatus is a printer based on the read device type information (step S1402).

In a case where the image forming apparatus 100 is a printer in step S1402, the processing part 260 substitutes 0 for KISYU that is a storage area secured in the RAM 262 (step S1403). In the second embodiment, a value thus substituted for KISYU is regarded as device type information. In a case where the image forming apparatus 100 is not a printer in step S1402, this means that the image forming apparatus is a multi-function peripheral, and the processing part 260 substitutes 1 for KISYU that is the storage area secured in the RAM 262 (step S1404).

Next, an operation of interrupting a printing operation in the second embodiment will be described. In the second embodiment, when the count value C is incremented or decremented (added to or subtracted from) in a control of interrupting a printing operation, an amount (increment or decrement) according to the device type of the image forming apparatus 100 is used.

In the image forming apparatus 100 in the second embodiment, an adding amount table 15 and a subtracting amount table 16 are stored in the non-volatile memory 270. The adding amount table 15 is such that the device type information and adding amounts (increments) added to the count value C are associated with each other. The subtracting amount table 16 is such that the device type information and subtracting amounts (decrements) subtracted from the count value C are associated with each other. The adding amount table 15 and the subtracting amount table 16 will now be described.

FIGS. 15A-15B show one example of the adding amount table 15 and the subtracting amount table 16. In the adding amount table 15, the device type information is associated with each of an adding amount (increment) to be added at a time of both-sides printing, an adding amount to be added at a time of one-side printing and an adding amount to be added at a time of an operation other than a printing operation. In the subtracting table 16, the device type information is associated with each of a subtracting amount (decrement) to be subtracted in a case where the count value C is equal to or more than the print allowing threshold C2, and a subtracting amount to be subtracted when the count value C is less than the print allowing threshold C2.

In the second embodiment, the adding amount table 15 and the subtracting amount table 16 are referred to, and an operation of interrupting a printing operation is controlled.

Figure 16A:
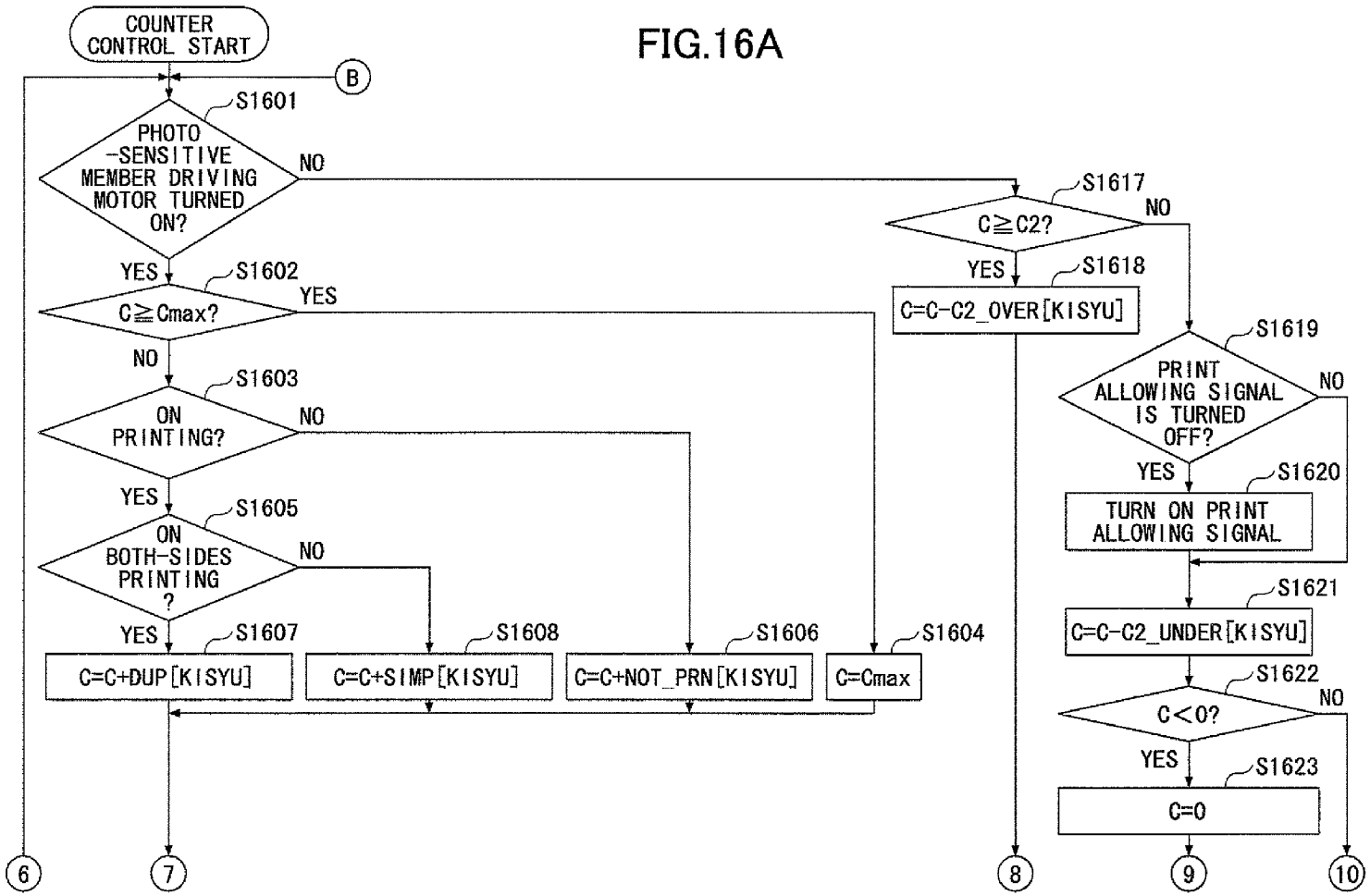
FIGS. 16A-16B and 17 show a flowchart illustrating adding and subtracting operations of a count value in the second embodiment of the present invention.
Figure 16B:
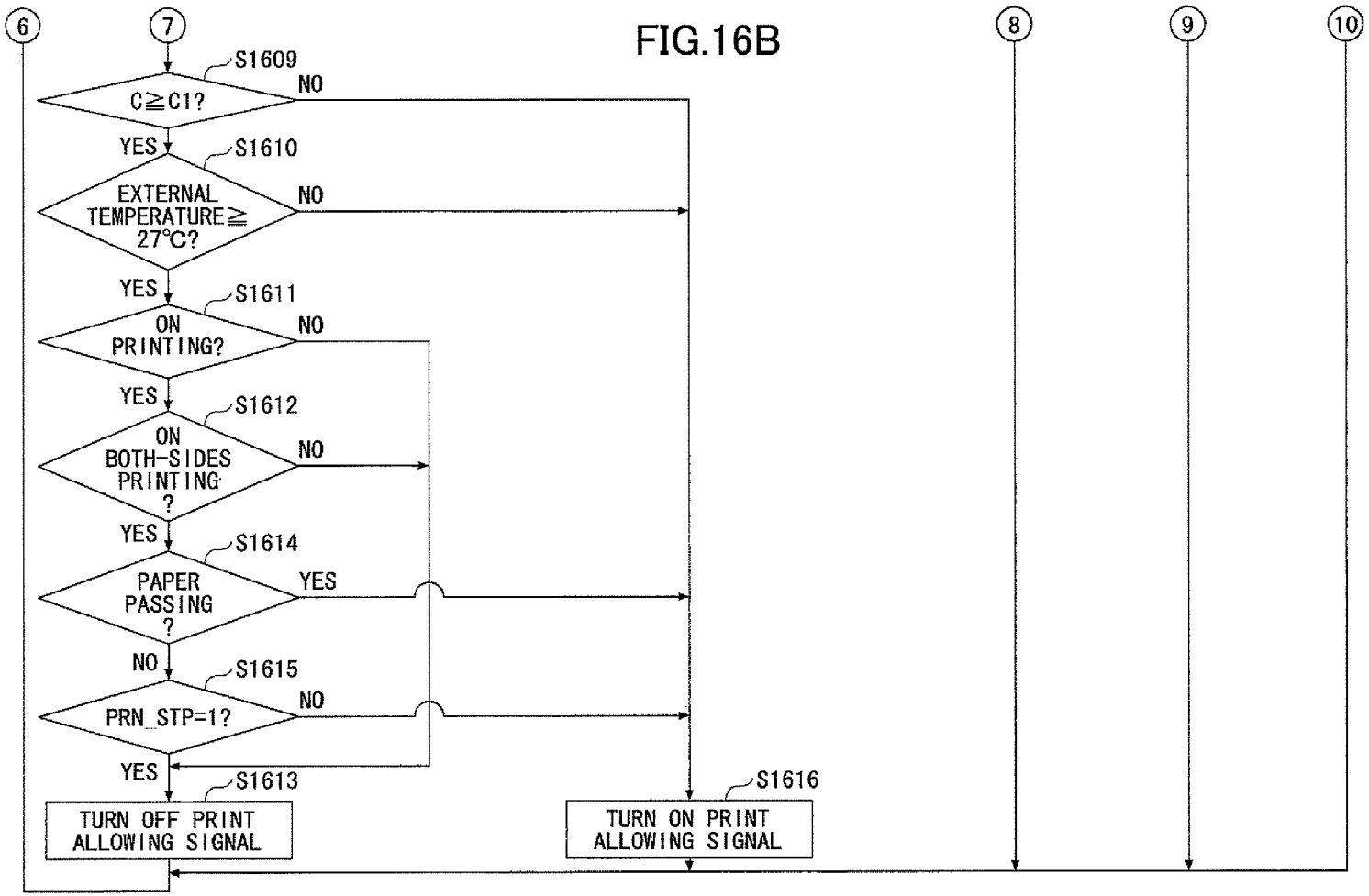

Below, with reference to FIGS. 16A-16B, a control of interrupting a printing operation in the second embodiment will now be described. FIGS. 16A-16B show a flowchart illustrating a process of adding to and subtracting from (incrementing and decrementing) the count value C in the second embodiment.

Processes of steps S1601 through S1604 in FIGS. 16A-16B are the same as steps S601 through S604 in FIGS. 6A-6B, and thus, duplicate description thereof is omitted.

In a case where the image forming apparatus 100 is not on a printing operation in step S1603, the processing part 260 refers to the adding amount table 15, and adds to the count value C a value corresponding to NOT_PRN[KISYU] (step S1606). For example, in a case where a device type of the image forming apparatus 100 is a MFP, a value "1" is substituted for KISYU. Therefore, the processing part 260 adds 2 corresponding to NOT_PRN[KISYU] for KISYU=1 in FIG. 15A to the count value C. For the other cases, the same method is applied.

In a case where the image forming apparatus 100 is not on a both-sides printing operation in step S1605, the processing part 260 refers to the adding amount table 15, and adds to the count value C a value corresponding to DUP[KISYU] (step S1607). In a case where the image forming apparatus 100 is not on a both-sides printing operation but on a one-side print operation in step S1605, the processing part 260 refers to the adding amount table 15, and adds to the count value C a value corresponding to SIMP[KISYU] (step S1608).

Processes of steps S1609 through S1614 in FIGS. 16A-16B are the same as steps S609 through S614 in FIGS. 6A-6B, except for a case where a determination result of any one of steps S1609, S1610 and S1614 is NO. Thus, duplicate description thereof will be omitted, and the case where a determination result of any one of steps S1609, S1610 and S1614 is NO will be described later.

In a case where no paper passing state occurs in the image forming apparatus 100 in step S1614, the processing part 260 determines whether the contents of PRN_STOP are 1 (setting for interrupting a printing operation is valid) (step S1615). In a case where the setting for interrupting a printing operation is valid in step S1615, the processing part 260 proceeds to step S1613.

The above-mentioned case where a determination result of any one of steps S1609, S1610 and S1614 is NO will now be described, together with a case where a determination result of step S1615 is NO. The processing part 260 finishes the current process of FIGS. 16A-16B with the print allowing signal turned on (step S1616), in any one of a case where the count value C is less than the printing preventing threshold C1 in step S1609, a case where the external temperature is less than 27° C. in step S1610, a case where a paper passing state occurs in the image forming apparatus 100 in step S1614 and a case where a setting for interrupting a printing operation is not valid in step S1615.

In a case where the photosensitive member driving motor 220 is turned off in step S1601, the processing part 260 determines whether the count value C is equal to or more than the print allowing threshold C2 (step S1617).

In a case where the count value C is equal to or more than the print allowing threshold C2 in step S1617, the processing part 260 refers to the subtracting amount table 16, and subtracts from the count value C a value corresponding to C2_OVER[KISYU] (step S1618). Then, the processing part 260 finishes the current process of FIGS. 16A-16B.

In a case where the count value C is less than the print allowing threshold C2 in step S1617, the processing part 260 determines whether the print allowing signal 213 is turned off (step S1619). In a case where the print allowing signal 213 is turned off in step S1619, the processing part 260 turns on the print allowing signal 213 (step S1620). In a case where the print allowing signal 213 is turned on in step S1619, the processing part 260 proceeds to step S1621.

In a case where the print allowing signal 213 is turned on in step S1620, the processing part 260 refers to the subtracting amount table 16, and subtracts from the count value C a value corresponding to C2_UNDER[KISYU] (step S1621). Processes of steps S1622 and 1623 are the same as those of steps S620 and S621 of FIG. 6A, and duplicate description thereof will be omitted.

Figure 17:
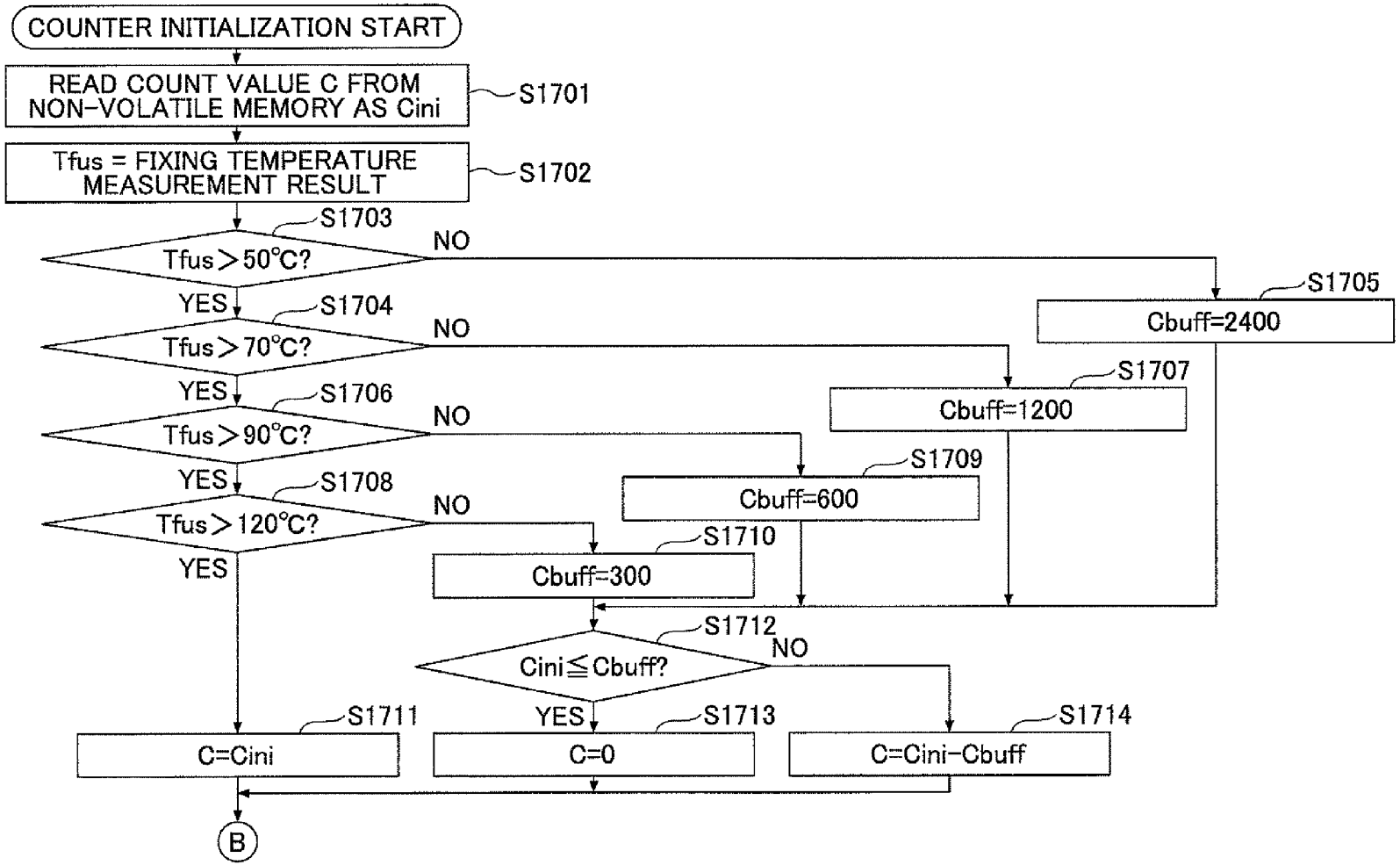

Next, with reference to FIG. 17, another operation of adding to and subtracting from (incrementing and decrementing) the count value C in the image forming apparatus 100 in the second embodiment will be described. FIG. 17 shows a second flowchart illustrating adding to and subtracting from the count value C in the second embodiment. A process described with reference to FIG. 17 is carried out once when a power supply is started in the image forming apparatus 100 and when the image forming apparatus 100 returns from the energy saving mode such as the sleep mode.

Processes of steps S1701 through S1714 are the same as those of steps S701 through S714 of FIG. 7, and duplicate description thereof will be omitted. When finishing a process of step S1711, S1713 or S1714, the processing part 260 returns to step S1601 of FIG. 16A, and carries out the process of FIGS. 16A-16B.

Figure 18:
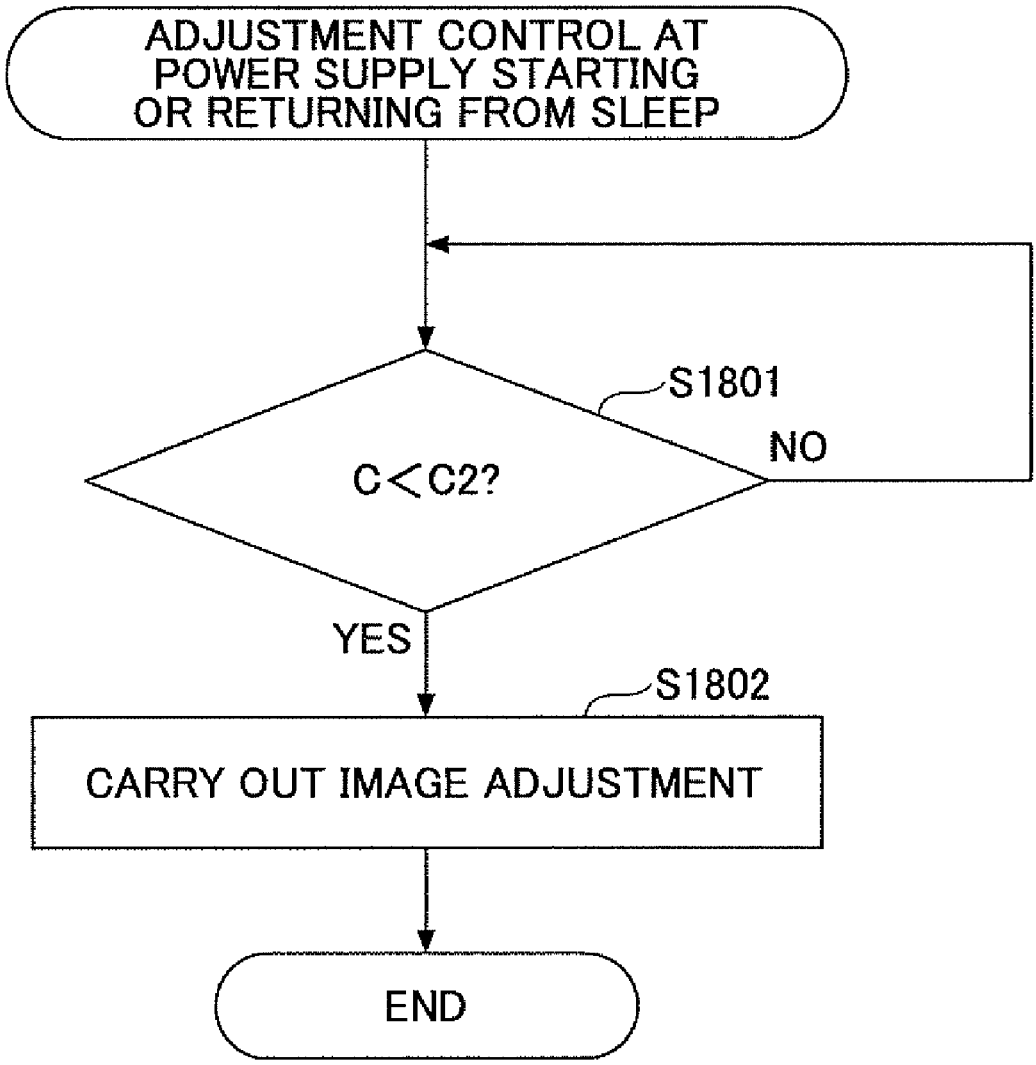
FIG. 18 shows a flowchart illustrating an image adjusting process in the second embodiment of the present invention.

Next, with reference to FIG. 18, an image adjustment process in the second embodiment will be described. FIG. 18 shows a flowchart illustrating the image adjustment process in the second embodiment. The process described with reference to FIG. 18 is carried out when a power supply is started in the image forming apparatus 100 and when the image forming apparatus 100 returns from the energy saving mode such as the sleep mode. The process described with reference to FIG. 18 is started up and carried out every 5 milliseconds.

In the second embodiment, in a case where the photosensitive member surface temperature is high, the image adjustment process is carried out after the photosensitive member surface temperature falls.

The processing part 260 determines whether the count value C is less than the print allowing threshold C2 (=2040) (step S1801). In a case where the count value C is equal to or more than the print allowing threshold C2 in step S1801, the processing part 260 repeats the process of step S1801, and waits for the count value C to become less than the print allowing threshold C2. In the second embodiment, at this time, devices such as the photosensitive member driving motor 220 and so forth stop.

In a case where the count value C is less than the print allowing threshed C2 in step S1801, the processing part 260 carries out the image adjustment process (step S1802).

Thus, in the second embodiment, the processing part 260 waits for the count value C to become less than the print allowing threshold C2. Therefore, it is possible to prevent the image adjustment process from being carried out while the photosensitive member surface temperature is high.

As described above, in the second embodiment, it is possible to interrupt a printing operation according to the photosensitive member surface temperature without requiring a temperature sensor, whether the image forming apparatus 100 is a printer that carries out only a printing operation or is a multi-function peripheral that carries out plural functions including a facsimile function, a scanning function and so forth in addition to a printing function. Thus, it is possible to avoid an image defect otherwise occurring because of an increase in the photosensitive member surface temperature, at low cost. Further, in the second embodiment, it is possible to shorten an interruption time (downtime), for every interruption occurring, of a printing operation being interrupted by the above-mentioned operation of interrupting a printing operation. Thus, it is possible to avoid degradation in productivity otherwise occurring because of a long interruption operation. This advantage is particularly effective for such a low-end user that the number of printing sheets every time is small.

Third Embodiment

Below, a third embodiment of the present invention will be described with reference to figures. The third embodiment of the present invention is different from the above-described first embodiment in that two fans are provided in the image forming apparatus. Therefore, in a description of the third embodiment below, only points different from the first embodiment will be described. For parts/components having the same functional configurations as those in the first embodiment, the same reference numerals as those in the first embodiment are given, and duplicate description thereof will be omitted.

The image forming apparatus 100A in the third embodiment carries out a control of interrupting a printing operation in consideration of a temperature in the outside of the image forming apparatus 100A.

Figure 19:
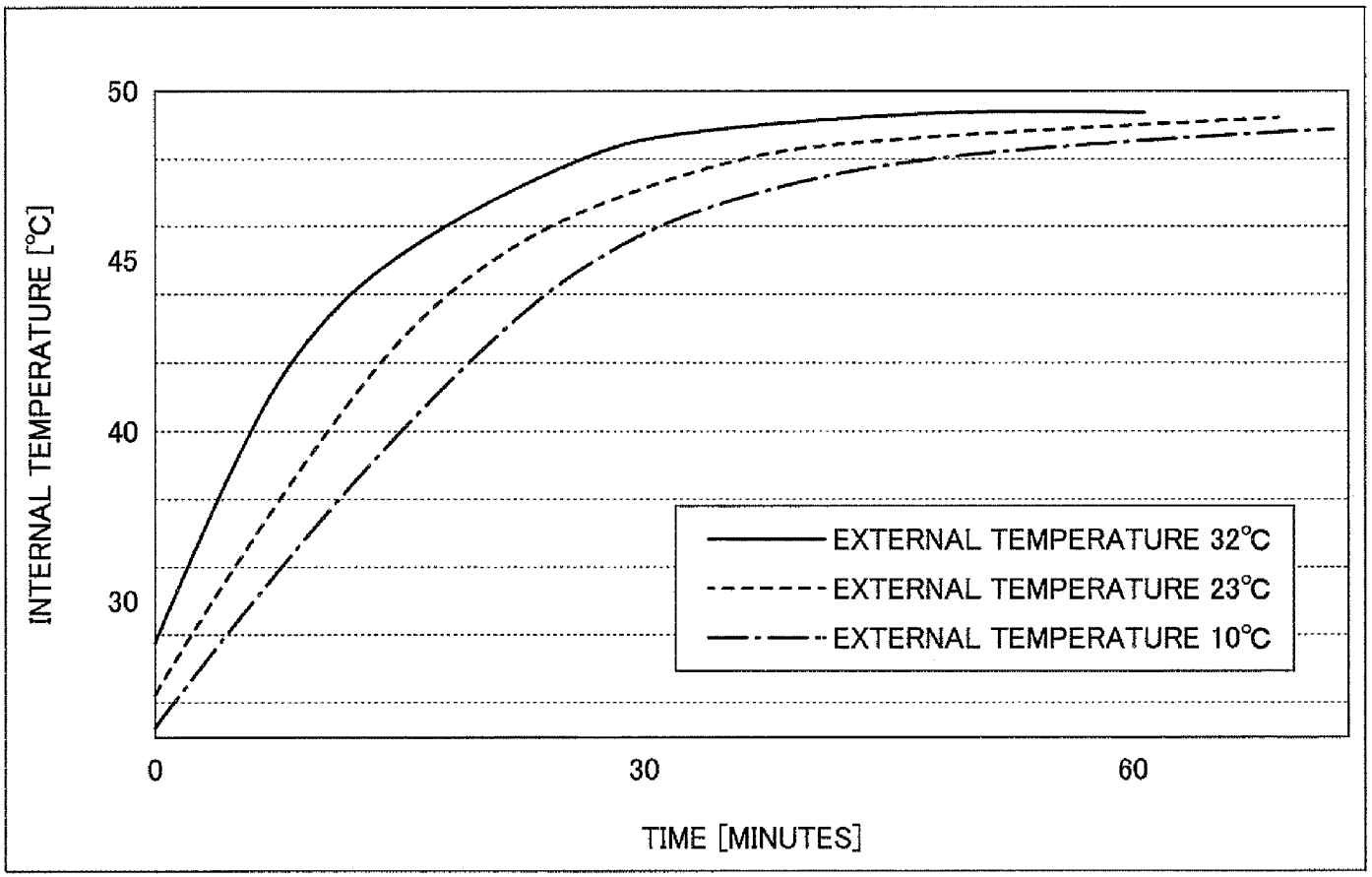
FIG. 19 shows a change in an internal temperature of an image forming apparatus during a printing operation.

A temperature in the inside of the image forming apparatus 100A (internal temperature) is affected by a temperature in the outside of the image forming apparatus 100A (external temperature). FIG. 19 shows a change in the internal temperature during a printing operation, and FIG. 20 shows a change of the internal temperature after a printing operation is finished.

Figure 20:
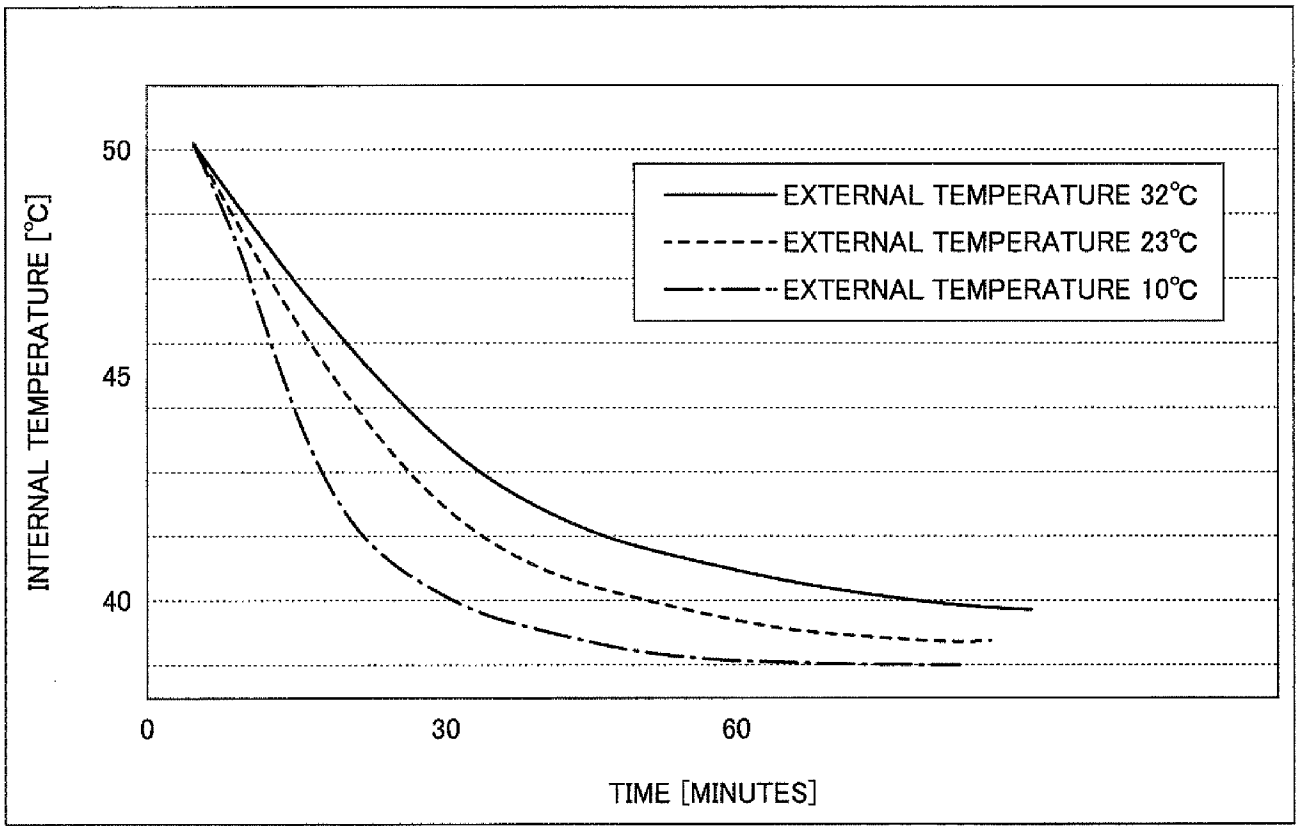
FIG. 20 shows a change in the internal temperature of an image forming apparatus after a finish of a printing operation.

It is seen from FIGS. 19 and 20 that the internal temperature of the image forming apparatus 100A is affected by the external temperature of the image forming apparatus 100A both during a printing operation and after a printing operation is finished. As the external temperature is higher, an increasing speed of the internal temperature is higher, and as the external temperature is lower, a decreasing speed of the internal temperature is higher.

Figure 21:
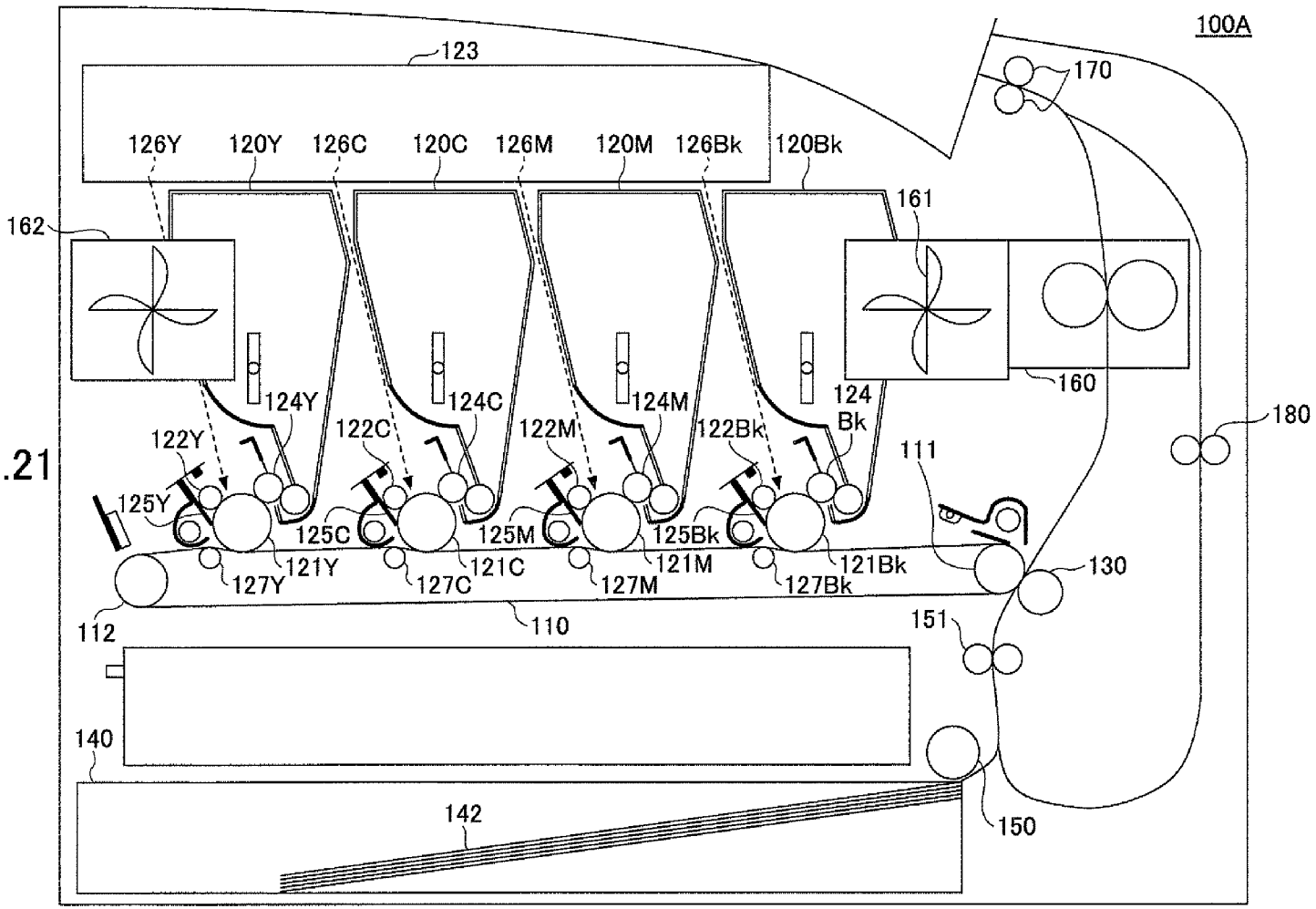
FIG. 21 shows a structure of an image forming apparatus 100A in a third embodiment of the present invention.

In the third embodiment, an influence of the external temperature of the image forming apparatus 100A is reduced. FIG. 21 illustrates the image forming apparatus 100A in the third embodiment. The image forming apparatus 100A in the third embodiment has a fixing cooling fan 161 and an internal cooling fan 162. The fixing cooling fan 161 is provided near the fixing unit 160, and cools the fixing unit 160. The internal cooling fan 162 is provided near the plural image forming parts 120Bk, 120M, 120C and 120Y, and cools the inside of the image forming apparatus 100A.

In the image forming apparatus 100A in the third embodiment, the fixing cooling fan 161 and the internal cooling fan 162 rotate at high speeds while the photosensitive member 121 rotates. When the photosensitive member 121 stops rotation, a time for which the high speed rotation of the fixing cooling fan 161 and the internal cooling fan 162 is continued is determined with reference to the count value C. Then, the fixing cooling fan 161 and the internal cooling fan 162 rotate at high speeds for the thus-determined time, and after that, rotate at low speeds.

In the third embodiment, for rotational speeds of the fixing cooling fan 161 and the internal cooling fan 162, levels are provided previously. That is, as the levels for the rotational speeds, a high-speed rotation level and a low-speed rotation level in which rotational speeds are lower than those in the high-speed rotation level are set. The fixing cooling fan 161 and the internal cooling fan 162 in the third embodiment rotate at high speeds or low speeds according to an instruction given by the processing part 260, for example.

In the image forming apparatus 100A in the third embodiment, the adding and subtracting amounts (increment and decrement) for the count value C are changed according to states of the fixing cooling fan 161 and the internal cooling fan 162. In the third embodiment, thereby, it is possible to prevent a decreasing speed of the internal temperature of the image forming apparatus 100A from being affected by the external temperature of the image forming apparatus 100A.

Figure 22:
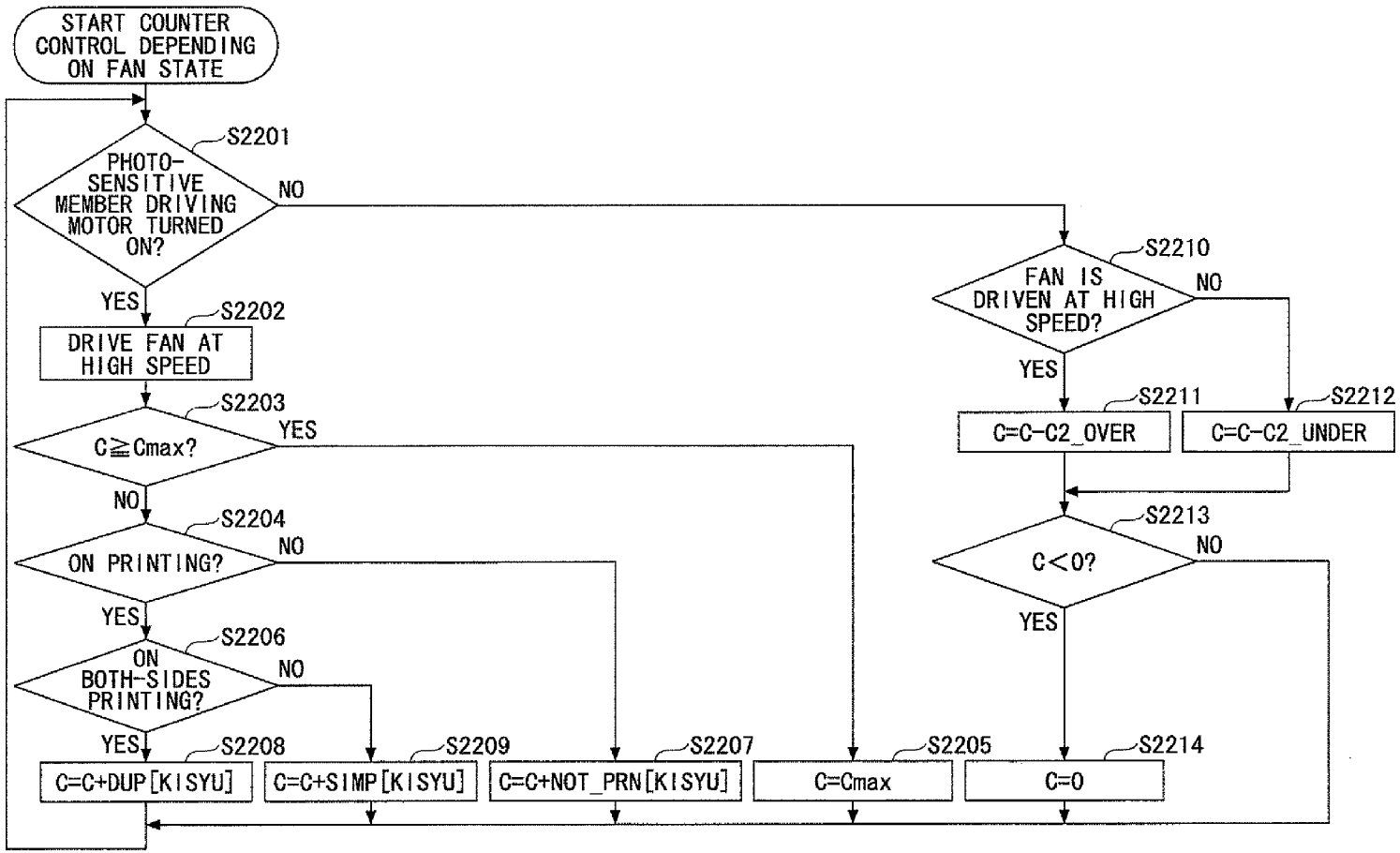
FIGS. 22-23 show a flowchart illustrating a process of changing an adding/subtracting amount for a count value C in the third embodiment of the present invention.

FIG. 22 shows a first flowchart illustrating a process of changing the adding and subtracting amounts (increment and decrement) for the count value C in the third embodiment. A process described with reference to FIG. 22 is started up and carried out every second.

In the image forming apparatus 100A in the third embodiment, the processing part 260 determines whether the photosensitive member driving motor 220 is turned on (step S2201). In a case where the photosensitive member driving motor 220 is turned on in step S2201, the processing part 260 determines rotational speeds of the fixing cooling fan 161 and the internal cooling fan 162 to be of the high-speed rotation level (step S2202).

Processes in steps S2203 through S2209 are the same as those in steps S1602 through S1608 of FIG. 16A, and duplicate description thereof will be omitted.

In a case where the photosensitive member driving motor 220 is turned off in step S2201, the processing part 260 determines whether the rotational speeds of the fixing cooling fan 161 and the internal cooling fan 162 are of the high-speed rotation level (step S2210).

In a case where the rotational speeds of the fixing cooing fan 161 and the internal cooling fan 162 are of the high-speed rotation level in step S2210, the processing part 260 refers to the subtracting amount table 16, and subtracts from the count value C a value corresponding to C2_OVER[KISYU] (step S2211). In a case where the rotational speeds of the fixing cooling fan 161 and the internal cooling fan 162 are not of the high-speed rotation level in step S2210 (i.e., of the low-speed rotation level), the processing part 260 refers to the subtracting amount table 16, and subtracts from the count value C a value corresponding to C2_UNDER[KISYU] (step S2212).

Processes in steps S2213 through S2214 are the same as those in steps S1622 through S1623 of FIG. 16A, and duplicate description thereof will be omitted.

In the third embodiment, in a case where the fixing cooling fan 161 and the internal cooling fan 162 rotate at high speeds, a decreasing speed of the photosensitive member surface temperature is high. Therefore, in the case of the high-speed rotation, the value larger than the value that is subtracted from the count value C in the case of low-speed rotation is selected (see FIG. 15B) as a subtracting amount to subtract from the count value C. Thus, in the case of high-speed rotation, the count C reduces within a short time. Thus, in the third embodiment, the count value C can be changed according to the rotational speeds of the fixing cooling fan 161 and the internal cooling fan 162.

Figure 23:
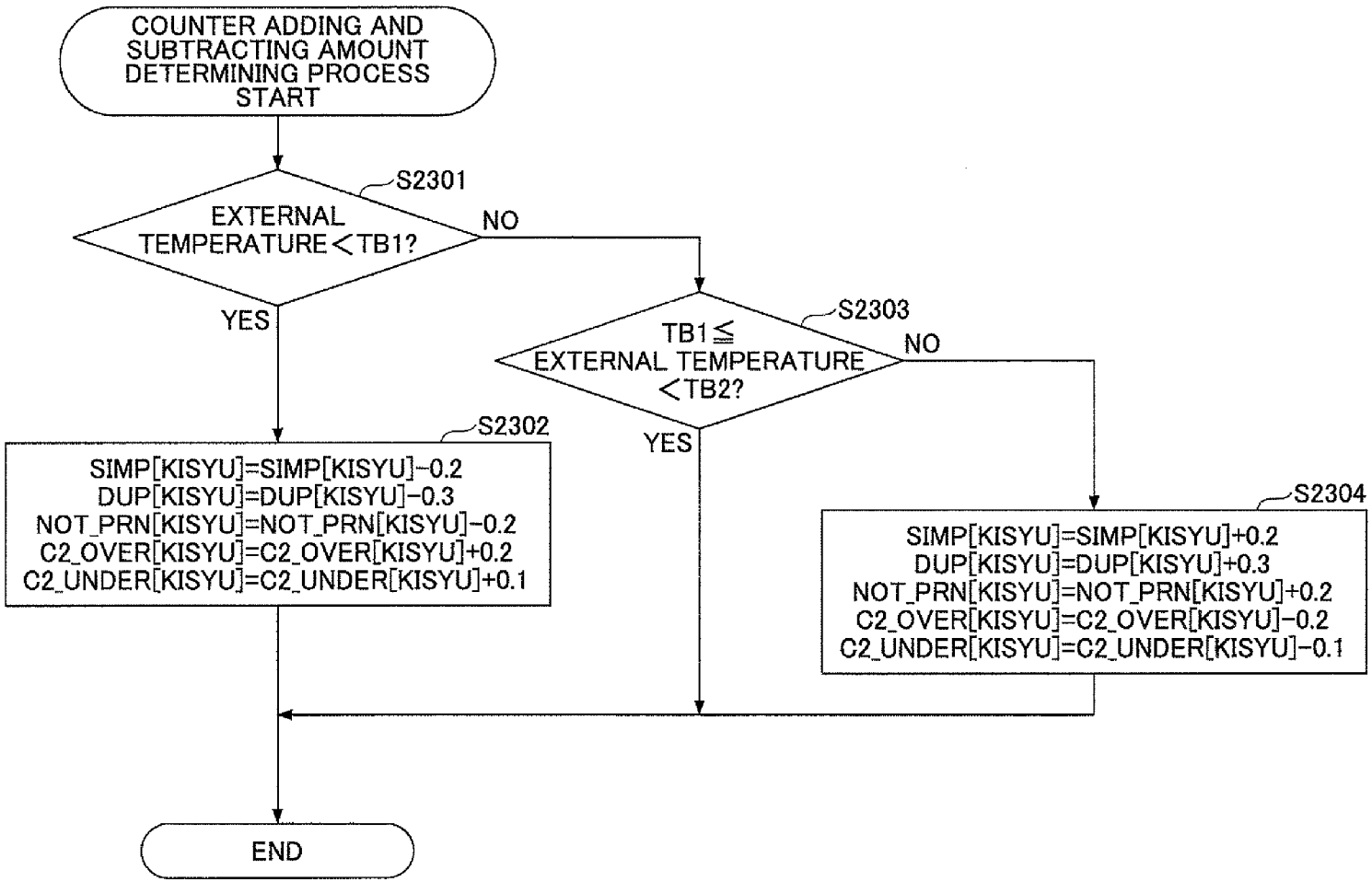

Next, with reference to FIG. 23, a process of changing the adding and subtracting amounts (increment and decrement) for the count value C according to the external temperature at a time when a power supply is started in the image forming apparatus 100A and when the image forming apparatus 100A returns from the energy saving mode such as the sleep mode.

FIG. 23 shows a second flowchart illustrating a process of changing adding and subtracting amounts (increment and decrement) for the count value C in the third embodiment. The process described with reference to FIG. 23 is started up and carried out only once when a power supply is started in the image forming apparatus 100A and when the image forming apparatus 100A returns from the energy saving mode such as the sleep mode.

In the image forming apparatus 100A, the processing part 260 determines whether the external temperature measured by the external temperature measuring part 250 is less than a TB1 (=15° C.) (step S2301).

In a case where the external temperature is less than TB1 in step S2301, the processing part 260 subtracts 0.2 from a value of SIMP[KISYU], 0.3 from a value of DUP[KISYU] and 0.2 from a value of NOT_PRN[KISYU] of the adding amount table 15 (step S2302). Further, the processing part 260 adds 0.2 to a value of C2_OVER[KISYU] and 0.1 to a value of C2_UNDER[KISM] of the subtracting amount table 16 (step S2302).

In a case where the external temperature is equal to or more than TB1 in step S2301, the processing part 260 determines whether the external temperature is equal to or more than TB1 and less than TB2 (=25° C.) (step S2303). In a case where the external temperature is equal to or more than TB1 and less than TB2 in step S2303, the processing part 260 finishes the current process of FIG. 23. In a case where the external temperature is not equal to or more than TB1 and less than TB2 in step S2303, the processing part 260 adds 0.2 to a value of SIMP[KISYU], 0.3 to a value of DUP[KISYU] and 0.2 to a value of NOT_PRN[KISYU] of the adding amount table (step S2304). Further, the processing part 260 subtracts 0.2 from a value of C2_OVER[KISYU] and 0.1 from a value of C2_UNDER[KISYU] of the subtracting amount table 16 (step S2304).

That is, in the third embodiment, based on the external temperature, the adding amount table 15 and the subtracting amount table 16 are updated. In the third embodiment, thereby, it is possible to control the count value C to make the count value C be a value that is one in consideration of the external temperature, and it is possible to reduce an influence of the external temperature.

Figure 24:
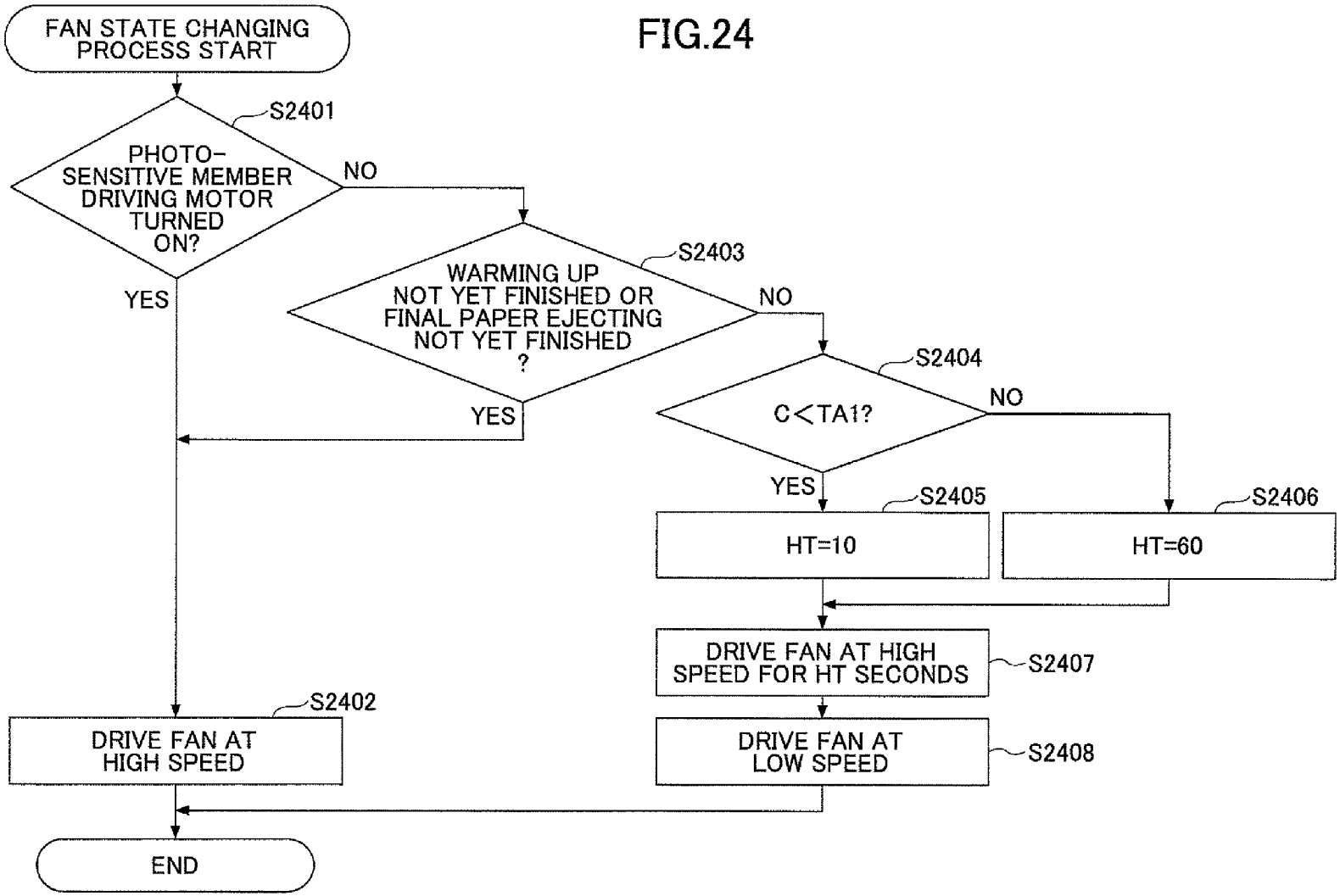
FIG. 24 shows a flowchart illustrating a control of a rotational speed of a fixing cooling fan 161 and an internal cooling fan 162 in the third embodiment of the present invention.

Next, with reference to FIG. 24, a control of rotational speeds of the fixing cooling fan 161 and the internal cooling fan 162 in the third embodiment will be described. FIG. 24 shows a flowchart illustrating a control of rotational speeds of the fixing cooling fan 161 and the internal cooling fan 162 in the third embodiment.

In the image forming apparatus 100A in the third embodiment, the processing part 260 determines whether the photosensitive member driving motor 220 is turned on (step S2401). In a case where the photosensitive member driving motor 220 is turned on in step S2401, the processing part 260 causes the fixing cooling fan 161 and the internal cooling fan 162 to rotate at high speeds (step S2402).

In a case where the photosensitive member driving motor 220 is turned off in step S2401, the processing part determines whether a warming up operation of the image forming apparatus 100A has not been finished yet, or whether final paper sheet ejection has not been finished yet (step S2403). The final paper sheet ejection means a final paper sheet being ejected in a series of a printing operation. For example, in a case where a printing operation for printing on three paper sheets is carried out, the final paper sheet ejection means the third paper sheet being ejected.

In a case where a warming up operation of the image forming apparatus 100A has not been finished yet, or final paper sheet ejection has not been finished yet in step S2403, the processing part 260 proceeds to step S2402.

In a case where a warming up operation of the image forming apparatus 100A has been finished, or final paper sheet ejection has been finished in step S2403, the processing part 260 determines whether the count value C is less than TA1 (=100) (step S2404). In a case where the count value C is less than TA1 in step S2404, the processing part 260 determines a high-speed rotation time HT for which the fixing cooling fan 161 and the internal cooling fan 162 are rotated at high speeds to be 10 seconds (step S2405). In a case where the count value C is equal to or more than TA1 in step S2404, the processing part 260 determines the high-speed rotation time HT for which the fixing cooling fan 161 and the internal cooling fan 162 are rotated at high speeds to be 60 seconds (step S2406).

The processing part 260 causes the fixing cooling fan 161 and the internal cooling fan 162 to rotate at high speeds for the high-speed rotation time HT determined in step S2405 or S2406 (step S2407). After finishing the high-speed rotation of the fixing cooling fan 161 and the internal cooling fan 162 for the high-speed rotation time HT, the processing part 260 then causes the fixing cooling fan 161 and the internal cooling fan 162 to rotate at low speeds (step S2408).

It is noted that the specific values of TA1 and the high-speed rotation time HT are obtained from experimental values or such. In the image forming apparatus 100A in the third embodiment, in a case where the count value C becomes equal to or more than 100, the high-speed rotation time HT is determined to be 60 seconds, thus the fixing cooling fan 161 and the internal cooling fan 162 are rotated at high speeds for the 60 seconds, and thereby, the internal temperature falls sufficiently. Further, in the image forming apparatus 100A in the third embodiment, in a case where the count value C is less than 100, the high-speed rotation time HT is determined to be 10 seconds, thus the fixing cooling fan 161 and the internal cooling fan 162 are rotated at high speeds for 10 seconds, and thereby, the internal temperature falls sufficiently also in this case.

The high-speed rotation time HT is determined in consideration of both reducing a time of rotating the fixing cooling fan 161 and the internal cooling fan 162 at high speeds to reduce noise, and sufficiently reducing the internal temperature of the image forming apparatus 100A to such a degree to avoid an image defect.

Thus, in the third embodiment, in a case where the count value C is smaller in comparison to the predetermined value TA1, it is determined that the internal temperature of the image forming apparatus 100A is not high, and the high-speed rotation time HT of the fixing cooling fan 161 and the internal cooling fan 162 is set shorter. Further, in a case where the count value C is larger in comparison to the predetermined value TA1, it is determined that the internal temperature of the image forming apparatus 100A is high, and the high-speed rotation time HT of the fixing cooling fan 161 and the internal cooling fan 162 is set longer.

Thus, in the third embodiment, it is possible to adjust the internal temperature of the image forming apparatus 100A while avoiding an influence of the external temperature without requiring a temperature sensor or such. Thereby, in the third embodiment, it is possible to perform a printing operation according to the photosensitive member surface temperature while avoiding an influence of the external temperature.

The present invention is not limited to the specifically disclosed embodiments, and variations and modifications may be made without departing from the scope of the present invention.

The present application is based on Japanese priority applications Nos. 2009-064573 and 2010-052379, filed Mar. 17, 2009 and Mar. 9, 2010, respectively, the entire contents of which are hereby incorporated herein by reference.

What is claimed is:

1. An image forming apparatus comprising:

a photosensitive member driving part configured to drive a photosensitive member;

the photosensitive member configured to be driven by the photosensitive member driving part and have an electrostatic latent image formed thereon;

a fixing part configured to fix a toner that adheres to the electrostatic latent image onto a recording sheet;

a counting part configured to carry out an adding operation when the photosensitive member driving part drives the photosensitive member, and carry out a subtracting operation when the photosensitive member driving part stops the photosensitive member; and a control part configured to interrupt, when a count value of the counting part becomes equal to or more than a first predetermined value, a printing operation of driving the photosensitive member, forming the electrostatic latent image on the photosensitive member, and fixing the toner adhering to the photosensitive member onto the recording sheet, and cause the counting part to start the subtracting operation.

2. The image forming apparatus as claimed in claim 1, wherein:

the control part is configured to start the printing operation when the count value of the counting part becomes equal to or less than a second predetermined value that is smaller than the first predetermined value.

3. The image forming apparatus as claimed in claim 1, wherein:

the counting part does not carry out the adding operation when the count value reaches a predetermined upper limit value.

4. The image forming apparatus as claimed in claim 1, further comprising:

a fixing temperature detecting part configured to detect a temperature of the fixing part; and a non-volatile storing part configured to store the count value, wherein:

when a power supply to the image forming apparatus is started or when the image forming apparatus returns from an energy saving mode, a value obtained from subtracting from the count value stored by the non-volatile storing part a value corresponding to a temperature detected by the fixing temperature detecting part is used as a new count value.

5. The image forming apparatus as claimed in claim 4, wherein:

a timing at which the count value is stored in the non-volatile storing part is a first timing during the printing operation and is a second timing different from the first timing during an operation other than the printing operation.

6. The image forming apparatus as claimed in claim 1, wherein:

the control part is configured to change an adding amount which the counting part adds to the count value and a subtracting amount which the counting part subtracts from the count value.

7. The image forming apparatus as claimed in claim 6, wherein:

the control part is configured to change the adding amount which the counting part adds to the count value according to whether the printing operation is a both-sides printing operation or a one-side printing operation.

8. The image forming apparatus as claimed in claim 6, further comprising:

an external temperature measuring part configured to measure an external temperature of the image forming apparatus, wherein:

the control part is configured to change the adding amount which the counting part adds to the count value and the subtracting amount which the counting part subtracts from the count value, based on the external temperature measured by the external temperature measuring part.

9. The image forming apparatus as claimed in claim 8, wherein:

the adding amount and the subtracting amount are a first adding amount and a first subtracting amount when the external temperature is less than a predetermined temperature and are a second adding amount and a second subtracting amount different from the first adding amount and the first subtracting amount, respectively, when the external temperature is equal to or more than the predetermined temperature.

10. The image forming apparatus as claimed in claim 8, wherein:

the control part is configured to interrupt the printing operation according to the external temperature measured by the external temperature measuring part.

11. The image forming apparatus as claimed in claim 6, further comprising:

a cooling fan that reduces an internal temperature of the image forming apparatus, wherein:

the control part is configured to change the adding amount which the counting part adds to the count value and the subtracting amount which the counting part subtracts from the count value, according to an operating state of the cooling fan.

12. The image forming apparatus as claimed in claim 11, wherein:

the cooling fan changes the operating state between a high speed rotating state and a low speed rotating state according to an operation of the image forming apparatus.

13. The image forming apparatus as claimed in claim 12, wherein:

the control part is configured to use, in a case where the photosensitive member driving part stops driving the photosensitive member, the subtracting amount when the operating state of the cooling fan is the high speed rotating state, which subtracting amount is larger than the subtracting amount used when the operating state of the cooling fan is the low speed rotating state.

14. The image forming apparatus as claimed in claim 12, wherein:

a high speed rotating time for which the operating state of the cooling fan is the high speed rotating state is a first time in a case where the count value is larger than a third predetermined value, and is a second time in a case where the count value is smaller than the third predetermined value, the second time being different from the first time.

15. The image forming apparatus as claimed in claim 14, wherein:

the high speed rotating time is determined according to a relationship between the count value obtained at a time of a printing sheet ejecting operation after the printing operation or a time of an end of a warming up operation carried out and the third predetermined value.

16. The image forming apparatus as claimed in claim 15, wherein:

the high speed rotating time is measured from the time of a printing sheet ejecting operation carried out after the printing operation or the time of an end of a warming up operation.

17. The image forming apparatus as claimed in claim 1, wherein:

the control part is configured to interrupt, in a case where the printing operation is a both-sides printing operation, the printing operation in such a manner as to prevent the recording sheet from passing through the image forming apparatus.

18. A printing operation control method carried out in an image forming apparatus in which a photosensitive member is driven, an electrostatic latent image is formed on the photosensitive member being driven, and a toner that adheres to the electrostatic latent image is fixed onto a recording sheet, the printing operation control method comprising:

carrying out an adding operation on a count value when the photosensitive member is being driven, carrying out a subtracting operation on the count value when driving the photosensitive member is stopped, and storing the count value in a storing part; and interrupting, when the count value stored in the storing part becomes equal to or more than a first predetermined value, a printing operation of driving the photosensitive member, forming the electrostatic latent image on the photosensitive member, and fixing the toner adhering to the photosensitive member onto the recording sheet, and starting the subtracting operation.

19. A computer-readable information recording medium storing a program which, when executed by a computer processor, performs a printing operation control method carried out in an image forming apparatus in which a photosensitive member is driven, an electrostatic latent image is formed on the photosensitive member being driven, and a toner that adheres to the electrostatic latent image is fixed onto a recording sheet, the printing operation control method comprising:

carrying out an adding operation on a count value when the photosensitive member is being driven, carrying out a subtracting operation on the count value when driving the photosensitive member is stopped, and storing a count value in a storing part; and interrupting, when the count value stored in the storing part becomes equal to or more than a first predetermined value, a printing operation of driving the photosensitive member, forming the electrostatic latent image on the photosensitive member, and fixing the toner adhering to the photosensitive member onto the recording sheet, and starting the subtracting operation.

* * * * *